United States Patent [19]

Brooks

[11] 4,265,039

[45] May 5, 1981

[54] DISPLAY SIGNS

[75] Inventor: Jackson R. Brooks, Ft. Collins, Colo.

[73] Assignee: ABC Extrusion Company, Ft. Collins, Colo.

[21] Appl. No.: 69,222

[22] Filed: Aug. 23, 1979

[51] Int. Cl.[3] ..... G09F 17/00

[52] U.S. Cl. ..... 40/603; 38/102.91; 40/549; 40/572; 40/575; 160/395

[58] Field of Search ..... 40/549, 564, 572, 574, 40/575, 578, 611, 616, 603, 157; 38/102.91; 160/392, 395, 327

[56] References Cited

U.S. PATENT DOCUMENTS

| | | | |
|---|---|---|---|
| 1,148,764 | 8/1915 | Faires | 160/395 X |
| 2,378,163 | 6/1945 | Thomas | 160/392 X |
| 2,573,318 | 10/1951 | Dow | 40/603 |
| 2,897,889 | 8/1959 | Kessler | 160/392 |
| 3,591,940 | 7/1971 | Slemmons | 40/603 |
| 3,696,857 | 10/1972 | Le Tarte | 160/395 X |
| 3,758,972 | 9/1973 | Egermayer | 40/603 |
| 3,885,335 | 5/1975 | Egermayer | 40/603 |
| 3,934,365 | 1/1976 | Stein et al. | 40/603 X |
| 3,978,905 | 9/1976 | de Lama et al. | 38/102.91 X |
| 3,982,345 | 9/1976 | Coleman | 40/564 |
| 4,007,552 | 2/1977 | Brooks | 40/606 |
| 4,041,861 | 8/1977 | Alter | 40/603 X |
| 4,107,826 | 8/1978 | Tysdal | 160/395 X |
| 4,188,764 | 2/1980 | Gode | 160/392 X |
| 4,194,312 | 3/1980 | Connors et al. | 38/102.91 X |
| 4,213,493 | 7/1980 | Haworth | 160/392 X |

*Primary Examiner*—John F. Pitrelli
*Assistant Examiner*—G. Lee Skillington
*Attorney, Agent, or Firm*—Hugh H. Drake

[57] ABSTRACT

A fabric is stretched across a sign framework to serve as a display face. Forming the framework are upper, lower and respective side support elements. Depending upon the particular version, a hinge or saddle is affixed to one or more of the support elements. A hinge pin tensioner has limited rotation and is coupled to a marginal portion of the farbric. In some versions, such hinge assemblies are included along more than one side of the framework. In others, different fasteners are employed along some of the support elements. In one particular approach, the fabric is stretched directly across a separate frame that, in turn, is hinged along a support element of the main framework, so that the frame may be swung away for the purpose of obtaining access to the interior of the main framework that usually encloses a source of illumination. At least almost every different component of the assembly is especially shaped and dimensioned so as to enable it to perform a plurality of different functions or tasks, thereby reducing the total number of components involved and the cost of assembly and installation.

82 Claims, 7 Drawing Figures

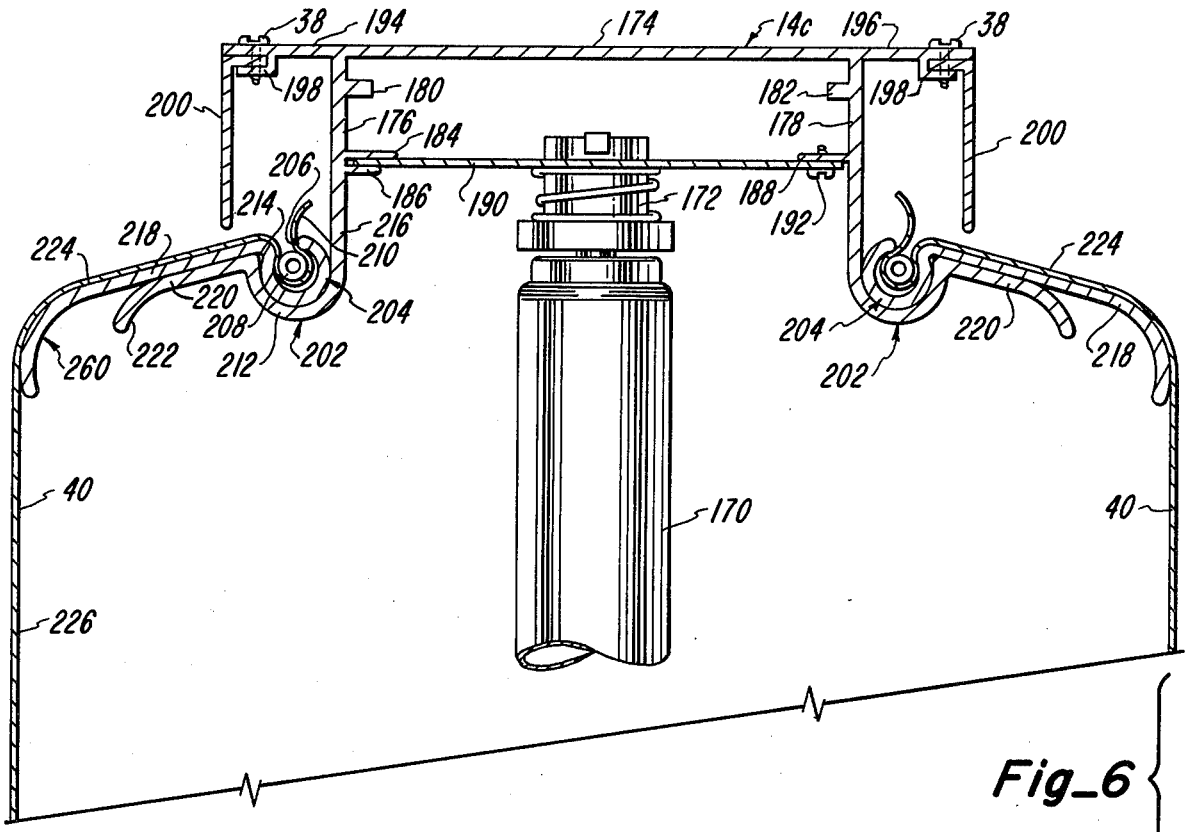
Fig_6
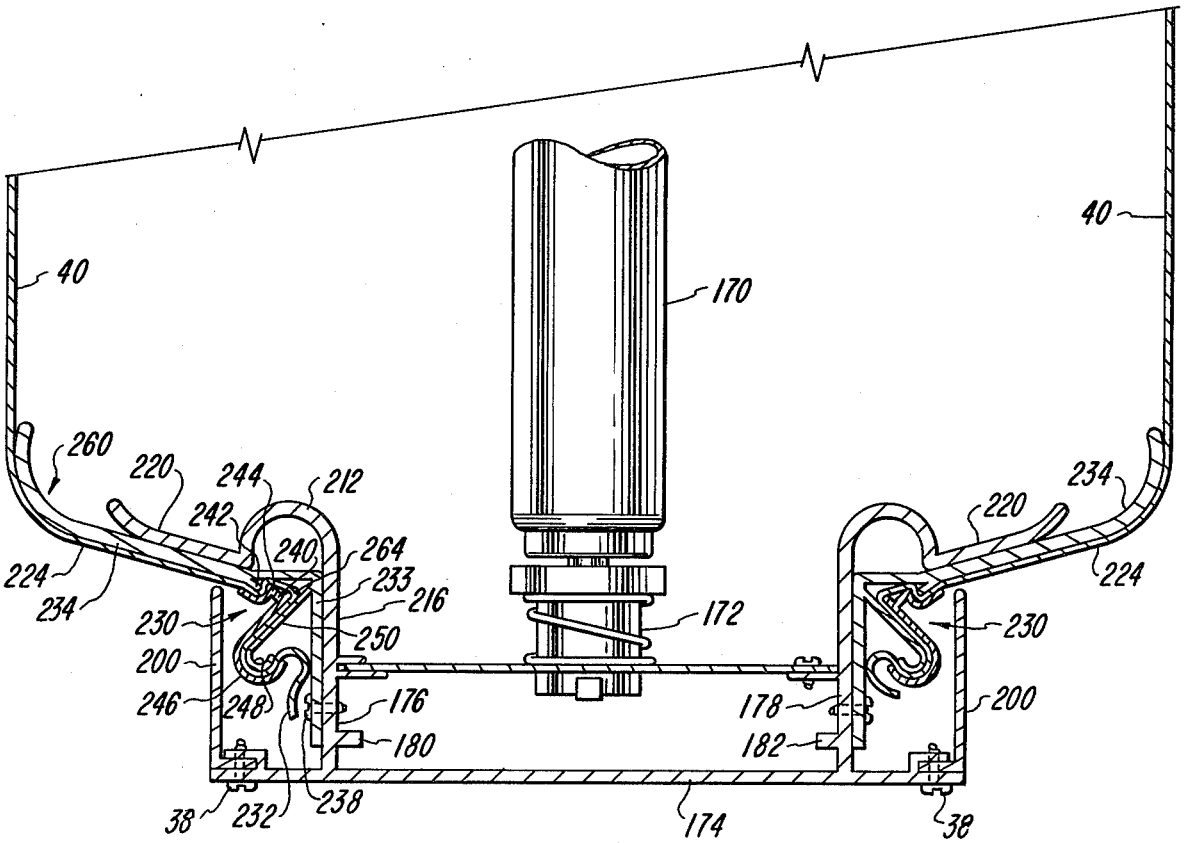

DISPLAY SIGNS

The present invention relates to display signs. More particularly, it pertains to signs which employ a stretchable fabric as a display face.

Signs have served a variety of purposes such as identifying a place of business, giving directional information, affording a warning and in promoting a product. It seems possible that one of the first outdoor signs visible at night may have been simply a painted signboard which normally would be visible only in the day time but which was illuminated by a flood light. It was not long, however, before displays were made self-illuminating by the use of a multiplicity of incandescent light bulbs arranged in patterns to define different letters, numbers and other characters. That approach led to the provision of a cabinet oriented so that at least one major surface served as a display face in which the bulb sockets were mounted. At the same time, the cabinet had a generally weatherproof interior within which the wiring was connected to the terminals on the various sockets and which would sometimes house associated components such as transformers and relays. A few of that kind of older sign may be found to be still in use today, and more modernized versions thereof are yet being installed, particularly for specialized purposes such as in scoreboards or to display moving messages to large audiences.

Another earlier display sign that once found widespread popularity had its characters formed from bent glass tubing which contained an illuminating gas such as neon. Here again, a cabinet often was employed to mount the neon tubing on a display face and also to protect wiring and transformers. Although "neon" signs are still used today, their popularity has substantially waned except for special applications.

A different early suggestion was to employ translucent or transparent display faces again mounted on a cabinet which housed the wiring and also contained the source of illumination. Characters were painted or otherwise formed on the display face. Unfortunately, about the only practical material available for the display faces was glass. As a result, frequent replacement cam to be expected because of breakage arising from missiles thrown by vandals, objects carried by the wind or the force of the wind itself.

Of major importance to the outdoor sign industry was the development, more than a generation ago, of rigid plastic sheets or panels formed of such materials as acrylic, polycarbonate, butyrate and variations thereof. One of the more popular has been a polycarbonate marketed by General Electric Company under the trademark LEXAN. It is reasonably unbreakable and exhibits sufficient surface hardness to withstand significant damage from most thrown or blown objects. Although often referred to as being "rigid", it actually exhibits a degree of resilient flexibility, and that can be both an advantage and a disadvantage. The advantage is that it is much safer and easier to handle than a material such as glass, and it also is capable of withstanding stresses developed by distortion in the cabinet and induced by wind or other forces. The primary disadvantage is that the same degree of flexibility also enables the sheet material to bow in an amount sufficient that the impact of severe wind is sufficient to cause the display face literally to blow out of the sign framework. At least usually, the face on the lee side first is sucked out by a combination of pumping by the other face and lowered pressure on the lee side. It has been stated that one major United States manufacturer spent approximately 1.4 million dollars in 1978 alone for the replacement of rigid plastic sign faces.

Other disadvantages of the rigid plastic sign faces include difficulties with cementing and other necessary fabrication techniques and in obtaining consistency of color during the production of a large number of display faces which are supposed to be identical. Additionally, the practical aspects of shipping, handling and installation limit the size of rigid plastic panels which may be used, so that larger signs require additional framework to support a plurality of panels arranged in a signal sign. The rigid plastic materials also are comparatively expensive. A typical outdoor sign might have dimension of 10×24 feet, and many such signs are much larger. The wind loss, coupled with the sizes involved and the expense of the material concerned, explains why it can cause just one company to spend in excess of a million dollars in a single year for replacements.

What appears to be a major improvement, capable of overcoming at least most of the above-discussed problems and disadvantages, has been the development of a soft, cloth-like, stretchable fabric material for use as a display face. As marketed by the 3M Company under the trademark PANAFLEX, it has a weight about the same as heavy canvas. It presents a smooth surface and is translucent for light from internal illumination. This material is a polyvinyl chloride which is re-enforced with glass fibers that run through the material in both directions in a pattern resembling that in ordinary window screens. As a result of that manner of fabrication, it is virtually impossible to tear; even if cut, the cut may not be extended by further tearing. Should it be cut, or penetrated as by a bullet, the cut or hole can easily be patched in the field in a manner similar to and no more difficult than applying a patch to an innertube.

As presently manufactured, the material is white. Moreover, the same company has developed special pigments for use in decorating its surface with different colors. Those pigments may be applied by the use of screen printing to produce full-color pictorials as well as letters, numbers and graphic symbols. A full range of colors is available, so that it is possible to perfectly match any standard color with consistency as between a large quantity of display faces. In contrast, the decoration of rigid plastic sign faces is limited, exhibits substantial inconsistency and, at least in certain colors, is prone to fade.

Besides being unbreakable, another advantage is that the material may be supplied in rolls. Within reason, that removes all practical limitations upon the size of a single display panel, and it greatly facilitates handling, shipping and installation.

Nevertheless, the fabric has some disadvantages. Like the rigid plastic material, it continues to be expensive. It currently becomes competitive only if produced in quantity for like sign faces. Because the decoration is printed with a special silk screen for each given decoration, and a multiple-colored presentation requires that color separation techniques be used in the printing, it becomes very expensive to make only a single sign. Under these circumstances, use has generally been restricted to the fabrication of like signs in quantities of about ten to one hundred or more. Nevertheless, the advantages have attracted substantial interest, and a demand has already developed for use of the material in signs of large size and quantity.

Of course, the stretchable fabric must be mounted to some sort of framework. The cabinet approach continues to be preferred, because that has a form factor ideally suited for the mounting in the row (or rows) of fluorescent tubes that today most commonly constitute the interior source of illumination. Moreover, the cabinet-type framework accommodates a weatherproof internal raceway in which lamp ballasts and connecting wiring may be disposed. Whatever the interior construction, the framwork must be extremely rugged to support the weight of larger signs and to withstand gale winds. One sign may weigh several thousand pounds. A person who has observed a sign mounted atop a tall building often will be surprised, if he has an opportunity to close insepection, to discover how large it has to be in order that that displayed lettering may be read from ground level. It is not uncommon for such a sign to have a display face area of many-hundred square feet.

To exhibit the ruggedness necessary in larger signs, it has long been known to fabricate such signs of steel frameworks. Either anlge or channel members are employed to form inwardly facing U-shaped channels which are mitred or otherwise joined successively one to the next in order to form a rectangular cabinet. Combinations of slots, ledges, clamps and the like have then been used to secure the rigid panels, that form the display faces, to the resulting framework. Steel frameworks are still widely used in the sign industry, particularly by the smaller, independent fabricators.

However, decided improvements in sign framework construction have been made during somewhat recent years through the use of aluminum extrusions to form the cabinet and the mounting components for the display faces. A leading example of such improvement is to be found in the disclosure of U.S. Pat. No. 4,007,552 issued Feb. 15, 1977 and assigned to the same assignee as the present application. In that case, a primary extrusion may serve to form all four sides of a sign cabinet, including the provision of a weatherproof but accessible wiring raceway. A combination of a groove and a shelf defined on a sidewall of the extrusion may be used in several different ways to hang and/or hold the marginal edge portions of a rigid plastic display face. Associated with the primary extrusion is another extruded part conventionally called a "retainer". It attaches to the primary extrusion and affords additional possible variation in the mounting of a rigid plastic display face. Whatever the mode of use, the retainer also serves as a bezel that presents an attractive appearance and conceals the mounting structure. These and other features of the approaches disclosed in the patent serve to reduce the cost of both material and labor, yielding a cost advantage over steel construction of about twenty-five percent. Yet, the resulting sign assembly still exhibits the necessary ruggedness discussed above.

Unfortunately, the specific embodiments shown in the aforesaid patent will not, by themselves, adequately or properly serve directly to mount the stretchable fabric type of display face. Neither will present frameworks formed of steel, and those are still to be found in widespread use at the present time. Without more and different hardware, therefore, it has not been possible to retrofit existing sign faces or to make direct use of prior techniques developed for rigid display faces. Such deficiencies in the former modes of sign construction arise because the stretchable fabric must be tensioned all around the perimeter of the display face. Moreover, the inducement of tension in the material also tends to cause it to gather into wrinkles.

For some six years or more, consideration has been given to the attendant problems. Many different types of hardware have been the subject of experimentation. Some has been in a form which was continuous entirely around the perimeter, while others have been spaced apart at a plurality of different points. The techniques tried have involved the use of grommets placed through the edge margin of the fabric, springs and clamping devices of several different kinds. Typically, such devices have been tested both in the laboratory and outdoors with the use of wind generating machines.

After assuring proper functioning in all respects, and also giving due consideration to the cost of parts and labor for installation, the originator of the PANAFLEX stretchable fabric has recommended an approach which involves the use of a clamp assembly at each of a plurality of locations spaced around the perimeter. Small holes are drilled or punched in the edge margin of the fabric with the holes typically being spaced successively apart by a distance of one foot or less. Each assembly includes a stamped steel clamp that has a pair of elements which are situated on opposed surfaces of the fabric and have apertures through which a bolt is inserted as well as through the hole formed in the fabric. A first nut tightens the clamp about the fabric. The other end is inserted through a hole formed in an arm of a bracket or hook by mens of a second nut theaded onto the outer end of the bolt. For installation, the bracket or hook is attached to the main structural framwork of the sign. After everything has been mounted, the fabric is tensioned by turning the aforementioned second nut to draw the suspended clamp toward the bracket.

The bracket may have whatever shape is necessary for the purpose of most conveniently securing it to a surface presented by the main framework. In one specific form that has been successfully used, it is shaped to include a portion which seats directly into the groove and shelf formed in the side wall of the primary extrusion shown in the aforesaid patent. Regardless of the kind of framwork employed, however, installation and adjustment of the multiplicity of clamp assemblies has been found to be tedious and time consuming. Adding to the time required has been the necessity of establishing a chalk line or other reference mark around the display face to determine the exact location of the required bolt holes for obtaining the proper amount of tension in the fabric.

For proper performance, each different face must be tensioned a given percentage of its length in the direction of the tension. Consequently, any given tensioning device must be capable of imposing an adjustable amount of tension, or an uneconomical variety of different tensioning devices have to be provided to accommodate different sizes of display faces. As an example of the variation required, the chalk line is located inwardly, from what would be a proper position for the clamping holes if stretching were unnecessary, an amount which varies between one-fourth inch for a visible opening dimension of two feet to two-and-one-eighth inches for a dimension of forty-five feet.

The tension induced in the fabric also creates a preload on the sign framework. That tends to inwardly bow its horizontal and vertical components. Using the PANAFLEX fabric, the resultant force is twenty pounds per foot all aroudnd the periphery. That requires a framework stronger and heavier than a rigid display face which is suspended or supported from the framework only along the top and bottom support elements and then by means of a rigid straight edge.

As indicated above, one problem with the use of rigid display faces is that the pressure imposed by high winds in the gale and hurricane categories can be costly. Because the rigid faces are likely to fracture or be blown out of place, this has the backhanded advantage or relieving the wind force on the overall sign frame assembly to save it from destruction. Since the stretchable fabric will not analogously break or tear under extreme wind conditions, however, the avoidance of possible wind damage to the remainder of the sign assembly requires that it must be designed to withstand the maximum possible wind load. Based upon Uniform Building Code requirements, present industry practice for signs which use rigid plastic display faces is to engineer sign structures to withstand a pressure of from a minimum of twenty to a maximum of forty-five pounds per square foot. To withstand the forces developed by anything less than a tornado, use of the PANAFLEX fabric requires a design to withstand a pressure of fifty-five pounds per square foot plus the pre-load discussed above.

Accordingly, a very strong framework and support are required if the user is to minimize replacement costs or for the manufacturer to offer a reasonable warranty. Although it might be possible to develop engineering and construction techniques that would prevent most display face failures now so prevalent with the use of rigid plastic faces, the increased strength demand on the main framework would raise the cost of material and labor to an extent that such a degree of reliability would become uneconomical. Similarly, the increased strength requirements placed upon a framework assembly for the stretchable fabric usually requires or at least makes highly desirable a stronger, and therefore more costly, framework construction. Fortunately, a framework system of the kind described in the aforementioned patent is sufficiently strong to meet the necessary criteria without any appreciable difference in construction techniques or material required.

One attractive feature of the rigid plastic display faces is that they can be molded into the now-familiar shape of a pan. The decoration appears on a generally flat surface, either plain or embossed, which merges into a peripherally-surrounding skirt the lip of which is secured to the main framework. Many users have developed a distinct preference for this shape of a display face. In addition, if often is desirable for the purpose of requiring only a comparatively narrow main framework or cabinet while yet achieving proper illumination from the interior of the cabinet. To obtain uniformity of illumination of the display face when using fluorescent lamps, it has been found that the center-to-center spacing between the lamps must not be greater than the distance between opposing display faces mounted on either side of the bank of lamps. Accordingly, and to retrofit existing frameworks that had carried pan-shaped rigid plastic faces, to satisfy user preference or to obtain proper uniformity of illumination, the stretchable fabric must be mounted in such a way as to be conformed to that same shape.

To permit placement of a stretchable fabric display face outwardly from a narrow cabinet, various approaches have been tried. One has involved the use of an extrusion so shaped as to cantilever the tensioning hardware away from the existing structure of a sign framework. However, that approach has not satisfied the consumer preference for what might be called the "molded pan look".

In any sign system, of course, it is necessary to provide access to the interior of the cabinet for the purpose of replacing wiring, lamps, ballasts or lamp sockets as well as to be able to clean the lamps and the inside of the display faces. Many signs now in use are constructed so that the rigid plastic faces can either be slid sideways or swung outwardly. The approach disclosed in the aforementioned patent offers an attractive alternative to either of the foregoing by its use of an exterior cover plate which may be opened or removed in order to gain access to the interior. Nevertheless, some customers prefer that access to the interior be obtained by opening of the display face. Of course, that requirement might have to be included in the case of retrofitting a fabric face to an existing main framework, So far as is known, that has not yet been possible with the hardware which has been developed to mount the stretchable fabric under tension. Especially in the case of retrofitting, it would also be desirable that any new mounting hardware permit its adaptation in the field without necessarily removing the main framework from its mount.

For the purpose of hinging a rigid plastic display face to a main framework, it has been known to join horizontal and vertical sections together so as to form an auxiliary frame which carries the display face as it is swung away from the main framework. That specific approach is illustrated in the aforementioned patent. To adapt that approach directly to the mounting of the stretchable fabric, however, would require that the axuiliary frame exhibit the same above-discussed ruggedness required for the main framework, in order to withstand the combination of possible wind forces and the tensioning preload.

Moreover, the tension induced in the fabric will bow the auxiliary frame members unless they also are so constructed as to exhibit a strength against deflection which corresponds to that of the main framwork. Clearly, costs would be increased substantially.

Another disadvantage with hardware presently available for the mounting of the stretchable fabric is the need for individual adjustment of tension and the handling of wrinkling at a large plurality of different locations spaced around the periphery of the display face. Those problems become accentuated when it is necessary to perform the necessary tasks on a frame assembly which is very large and/or spaced high above the ground or other mounting surface.

In view of all of the foregoing, it will be seen tht the use of a stretchable fabric for display faces is attractive for a number of reasons. Yet, it also has presented several disadvantages because of its special characteristics that create a variety of new and different problems. Consequently, the sign industry as a whole has been very reluctant to adopt the stretchable fabric for widespread use.

It is, accordingly, a general object of the present invention to provide a new and improved approach which features the leading advantages present in each of the above-described prior techniques while avoiding the disadvantages thereof.

A specific object of the present invention is to provide new and improved approaches for use in the mounting and tensioning of display faces formed of stretchable fabric material.

A further object of the present invention is to provide better hardware which is capable of both mounting and inducing the necessary tension in a stretchable fabric display face.

Another object of the present invention is to provide a manner of mounting such a display face which avoids any need for the formation of holes or other openings in the material of the display face itself.

Other objects of the present invention are to provide new an improved approaches to and components for the use of stretchable fabric display faces and which (1) permit better incremental adjustment of tension at different points around the periphery of the display face, (2) enable adjustment of the physical position of different portions of the material in order to adjust for wrinkling, (3) enable adaptation of various different improvements of this invention to a wide variety of presently existing sign frameworks or cabinets, (4) accommodate implementation of various improvements afforded by the present invention directly into newly fabricated sign frameworks, (5) enable the fabrication of signs which are economical and yet capable of withstanding even hurricane-force winds without damage, (6) permit the use of an assembly in which the face is swingable away from the main framework, (7) obtain the "molded pan look", (8) permit the new use of or retrofitting to narrow main frameworks or cabinets while yet obtaining uniformity of illumination from interior lamps, (9) enable the use of a simplified and lightweight auxiliary frame for direct mounting of the fabric while yet avoiding wind damage or distortion of the auxiliary frame, (10) permit the retrofitting or existing signs in the field without any need to remove such a sign from its mounting, (11) minimize the amount of field work required for installation and making necessary adjustments on sign frames of large size and/or mounted high above the supporting surface and (12) generally better satisfy user requirements and perferences.

The invention is, therefore, directed to a fastening assembly for use in securing a stretchable fabric display face across a sign framework that has upper and lower support elements joined between corresponding opposite ends by respective side support elements. A hinge is affixed in use to at least one of the support elements, and a hinge pin is mated therewith for rotation. That rotation of the hinge pin is limited. A marginal portion of the fabric is coupled to the hinge pin.

Each of the elements just mentioned desirably also performs several additional functions other than the one respectively stated. That leads to the availability of a number of different features as implemented in various different combinations. One important further feature is that the coupling means is adjustable between a first condition wherein the marginal portion is fixed in position relative to the hinge pin and a second condition wherein that marginal portion is movable relative to the hinge pin. Another related additional feature is that the coupling means is so formed as to permit adjustment from the second condition to the first condition in response to tension developed within the fabric upon stretching thereof. More generally, the combination enables selective adjustment of the tension induced in the fabric. Other features pertain to the use of means for causing the resulting display face to have the "molded pan look" and an arrangement for supporting the display face in tension on a separately mountable auxiliary frame.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

FIG. 6 is an enlarged vertical cross section of a sign assembly similar to that shown in FIG. 1 but illustrating still different alternative embodiments of a number of different components.

Figure 1:
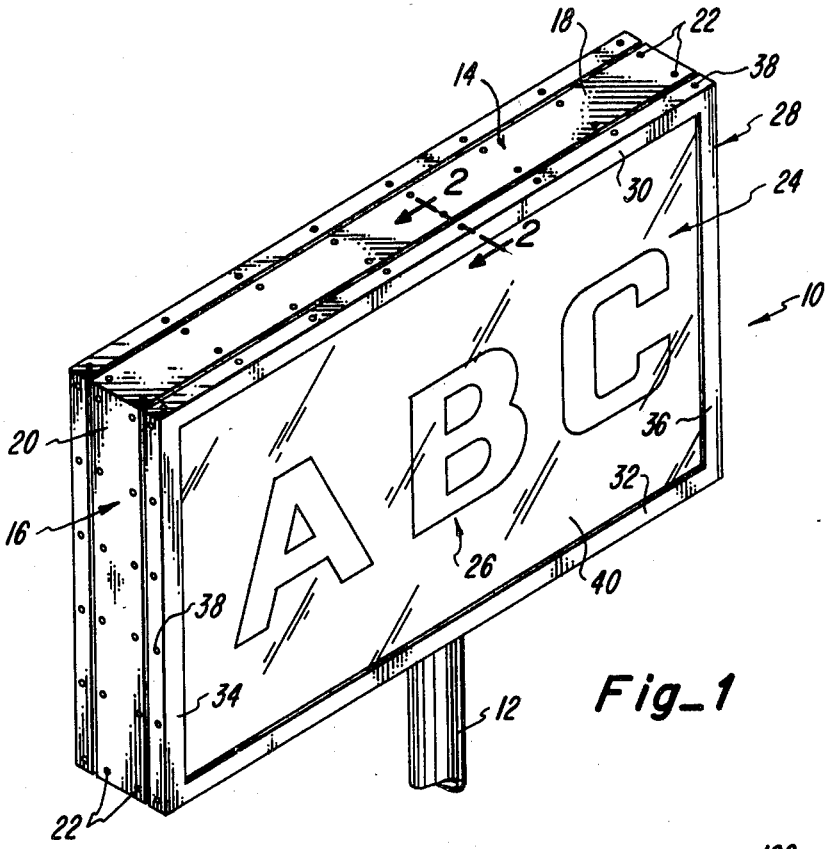
FIG. 1 is an isometric view of an overall display sign assembly constructed in accordance with one embodiment of the present invention.

An overall display sign assembly 10 is shown in FIG. 1 as mounted on the top of a post 12. Its main framework or cabinet is composed of space-opposed upper and lower support elements joined between corresponding opposite ends by respective side support elements. In FIG. 1 only upper support element 14 and one side support element 16 is visible. Even then, what actually is seen in FIG. 1 are cover plates 18 and 20 each of which is removably secured by screws 22 to an underlying portion of the basic framework. Each of the lower and other side support elements, not seen in FIG. 1, may be identical except, of course, for the coupling that is affixed to the top of post 12.

For economy of construction, it usually is preferred that all of the support elements be cut from the same stock material after which they are mitred or otherwise formed at their corners and successively joined one to the next in order to complete the rigid framework. Nevertheless, it may be preferred for other reasons to include differences between various ones of the support elements. For example, a cover plate usually is not necessary on all four sides for the purpose of providing access to the interior.

As used herein, the terms "upper", "lower" and "side" are somewhat arbitrarily assigned for the purposes of reference during the discussion, although they have been selected to represent what is probably the most common orientation of a rectangular sign. Obviously, the sign could, for example, be so oriented that its longer sides define the vertical dimension.

Stretched across the visible main surface of sign assembly 10 is a display face 24 upon which is printed decoration 26. In this case, the decoration is simply the letters ABC. In the usual manner of display signs, it may be of any character, including a pictorial, numbers or graphics.

Surrounding the perimeter of display face 24 and also of the framework is a bezel or retainer 28. The term "retainer" is mentioned herein only because that is the commonly accepted name in the industry for the part which appears in its position as illustrated. As will be seen, the retainers employed herein in connection with the different embodiments need not have any function other than to provide a degree of weatherproofing and lend attractiveness to the overall assembly by concealing from view certain parts yet to be described. Here again, retainer 28 is composed of space-opposed upper and lower members 30 and 32 joined between corresponding opposite ends by respective side members 34 and 36 and all affixed to the main framework by screws 38.

As between the various different specific embodiments to be discussed below, it is to be understood that FIG. 1 is merely illustrative. As drawn, its exterior appearance is more or less fully consistent only with the embodiment detailed in FIG. 3. A glance at FIGS. 2, 5 and 7 will reveal, for example, differently-shaped retainers, and it will be observed that FIG. 6 particularly has a distinct difference in the shape of the display face. In all embodiments, however, display face 24 is made from a stretchable fabric 40. As embodied herein, fabric 40 is a soft, cloth-like sheet of polyvinyl chloride reinforced by an internal matrix of fiberglass strands. Particularly desirable is the PANAFLEX fabric described in the introduction. It presents a smooth finish and also is translucent to the illumination as conventionally emanating from fluorescent lamp tubes disposed within the interior of the sign cabinet or framework.

Interior illumination is contemplated for use in connection with all embodiments. Of course, it will always be possible to omit the interior source of illumination and, instead, employ exterior floodlighting or employ the sign only for daylight viewing. It also is contemplated throughout that the sign assembly is to have a display face 24 forming each of its space-opposed major surfaces. In some cases, however, the opposite display face is omitted as in the case where the back of the sign is to be mounted against the surface of a wall. In that situation, it would be desirable to cover the backside of the sign assembly with a less expensive material such as sheet metal.

Figure 2:
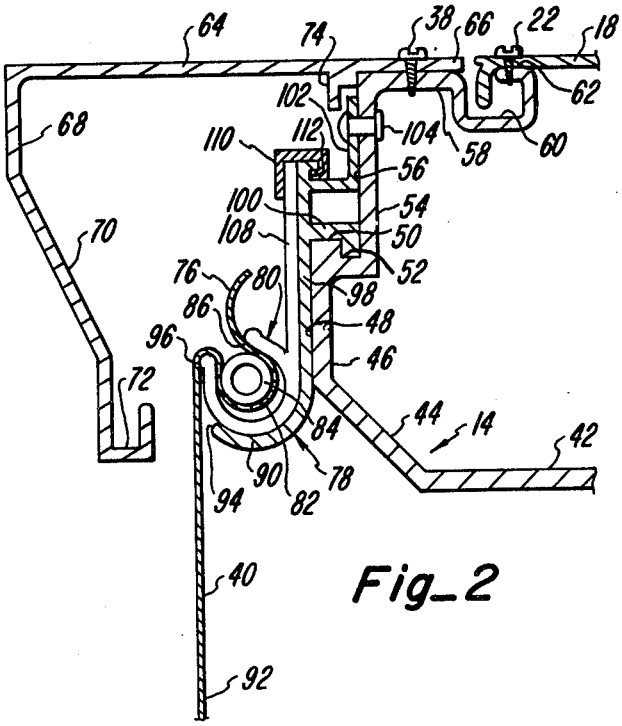
FIG. 2 is a fragmentary and enlarged cross-sectional view taken as if along the line 2—2 in FIG. 1 but with a revision of one component.

In FIG. 2, an upper support element 14 is an aluminum extension with a cross-sectional shape that is almost identical to that of the aluminum extrusions employed as support elements in the disclosure of the aforesaid U.S. Pat. No. 4,007,552. For that reason, and also to indicate background considerations and minor modifications that may in a given instance be desired, that patent is incorporated herein by reference. Because a large number of display signs are presently in use that include support members having essentially the same cross-sectional shape as that disclosed in the patent, the embodiment of FIG. 2 is particularly intended to be used in those situations where it is desired to retrofit an existing display sign that has a rigid plastic display face with a display face made of the stretchable fabric to which all embodiments of the present invention are addressed.

In particular, support element 14 has a cross-sectional shape in the general form of an outwardly-opening U-shaped channel. As illustrated more fully in the patent, fluorescent lamp sockets and a ballast transformer are carried on its bottom wall 42 and the channel defines a raceway in which the inter-connecting wiring is housed. The margin of bottom wall 42 continues into an upwardly sloping wall 44 that merges into a side wall 46, defining an exteriorly facing surface 48 and terminating in a ledge 50. Defined immediately inside ledge 50 is a groove or recess 52 from which an inset side wall portion 54, that presents an exteriorly-facing surface 56, continues upwardly and then is bent inwardly to define a shelf 58. Inwardly beyond shelf 58, the extruded material is shaped to define a rain-drainage channel 60 and then turns back re-entrantly to form another shelf 62 on which an edge margin of cover 18 is disposed and secured by screws 22.

As between the different figures hereof, the various retainers illustrated have corresponding different shapes so as to present a variety of external appearances. These differences in appearance are merely illustrative. The appearance-determining shape of any one retainer may be incorporated into the retainer as specifically shown in any of the other figures. In FIG. 2, a retainer 64 has an inner margin 66 which is secured by screws 38 over shelf 58 and continues substantially beyond side wall portion 54 before turning downwardly as a border 68 and on into a panel 70 that slopes back toward the display face and then terminates in a re-entrantly-shaped hook portion 72. Projecting downwardly from the inside of retainer 64 immediately beyond its edge margin 66 is a lug 74 that serves to enable proper alignment on installation of the retainer. Actually, the shape of lug 74 is from an earlier approach in which it served to trap a portion of hardware described in the introduction for mounting grommets. It also would serve to retain a corrugated rigid plastic face.

It nevertheless will be observed by reference to the above-identified patent that retainer 64 is basically the same retainer as disclosed therein. One purpose of including it in FIG. 2 is to point out that, in retrofitting an existing sign constructed in accordance with the teachings of the patent, even a retainer based on the original sign system may continue to be used. In addition, sloping panel 70 of the retainer continues to serve as an attractive feature in defining what may be called a "picture frame" appearance.

As a fastening assembly for the marginal edge portion 76 of the fabric, the arrangement of FIG. 2 includes a hinge or saddle 78 that is affixed to support element 14 and within which a hinge pin or tensioner 80 is mated for rotation. The amount of rotation of hinge pin 80 is limited, and marginal portion 76 is coupled to the hinge pin. In this case, hinge pin 80 is of generally C-shaped or horseshoe-like cross section, so as to be hollowed out to define an interior cavity 82 within which marginal portion 76 is secured.

Disposed within cavity 82 is a wedge 84, in this case in the form of a dowel or cylinder with a cross-sectional area less than that of the main portion of the cross section of hinge pin 80 but yet which is of a width greater than the distance between the free ends of the hinge pin at the mouth 86 thereof. Thus, wedge 84 is captivated or captured within cavity 82 by mouth 86.

Marginal portion 76 is led into and out mouth 86 and partially wrapped around wedge 84 to reside between the wedge and the inner of hinge pin 80 which defines cavity 82. As a result of its shape and loose fit within cavity 82, wedge 84 serves as a keeper and cooperates with hinge pin 80 to permit adjustment between a first condition wherein portion 76 is fixed in position relative to the hinge pin and a second condition wherein that marginal portion is movable relative to the hinge pin. The tight fit of wedge 84 within mouth 86 causes it to secure itself against and thereby fix the position of marginal portion 76 in response to tension which is developed within fabric 40 upon stretching thereof.

Hinge 78 includes a segment 90 against the inner surface of which hinge pin 80 is nested. In this instance, segment 90 embraces less than one-half the distance around hinge pin 80. It will be observed that the concave inner surface of segment 90 faces away from the central portion 92 of the resulting display face, with fabric 40 continuing away from hinge pin 80 and marginal portion 76 directly into the formation of central portion 92. The outer end 94 of segment 90 is disposed adjacent to and yet spaced from fabric 40. With the source of illumination disposed within the framework of which support element 14 is a part and, thus, inside of the display face formed by fabric 40, end 94 of segment 90 defines an edge of the area of illumination of the display area which constitutes the central portion of fabric 40. Mouth 86 flares slightly apart at its outer end so as to define at one side an abutment 96 on the outer wall of hinge pin 80. Upon engaging segment end 94, abutment 96 defines one limit for the extent of rotation of hinge pin 80.

Integrally affixed to and projecting away from hinge 78 at the other end of segment 90 is a finger 98. Finger 98 is in the form of a web and, in the condition illustrated in FIG. 2, has one side which lies flat against surface 48 of support element 14. A cleat 100 projects from finger 98 and projects over ledge 50 in order to seat in recess 52. With fabric 40 under tension, that seating of cleat 100 in recess 52 is sufficient to retain hinge 78 in a fixed position. Preferably, however, a bracket 102 also projects away from finger 98 and presents a flat portion against the surface 56 of upper side portion 54, with a rivet 104 or other suitable fastener securing bracket 102 firmly to support element 14 and thereby prohibiting possible dislodgement of hinge 78.

A lever 108 is integrally affixed at one end to and projects away from hinge pin 80. In the position shown in FIG. 2, lever 108 lies alongside finger 98 so as thereby to define another limit of rotation of hinge pin 80. This limit, and the one established by the engagement of abutment 96 with segment end 94, serves to restrict the amount of rotation of hinge pin 80 to but a fraction of one revolution. To secure lever 108 to finger 98 upon reaching that limit of rotation, a keeper 110 is engageable around the free end of lever 108 and finger 98. Specifically in this version, finger 98 is shaped to define a recess 112, and keeper 110 has an in-turned end portion which is engaged in recess 112.

To install fabric 40, its marginal portion 76 is threaded into mouth 86, around wedge 84 and then back out of mouth 86. With wedge 84 loose within cavity 82, or even forced to approximately the center of the cavity, marginal portion 76 may be pulled through as desired with respect to either the positioning of that part of the marginal portion being worked upon or with respect to the inducement of tension within fabric 40. In applying tension to fabric 40, it typically tends to gather in places and form wrinkles. Those may be readily smoothed out by releasing wedge 84 from its securing position and, beginning at the center of a margin, wiping the outer surface of fabric 40 to move the material away from the center and outwardly toward an end of that margin.

Figure 4:
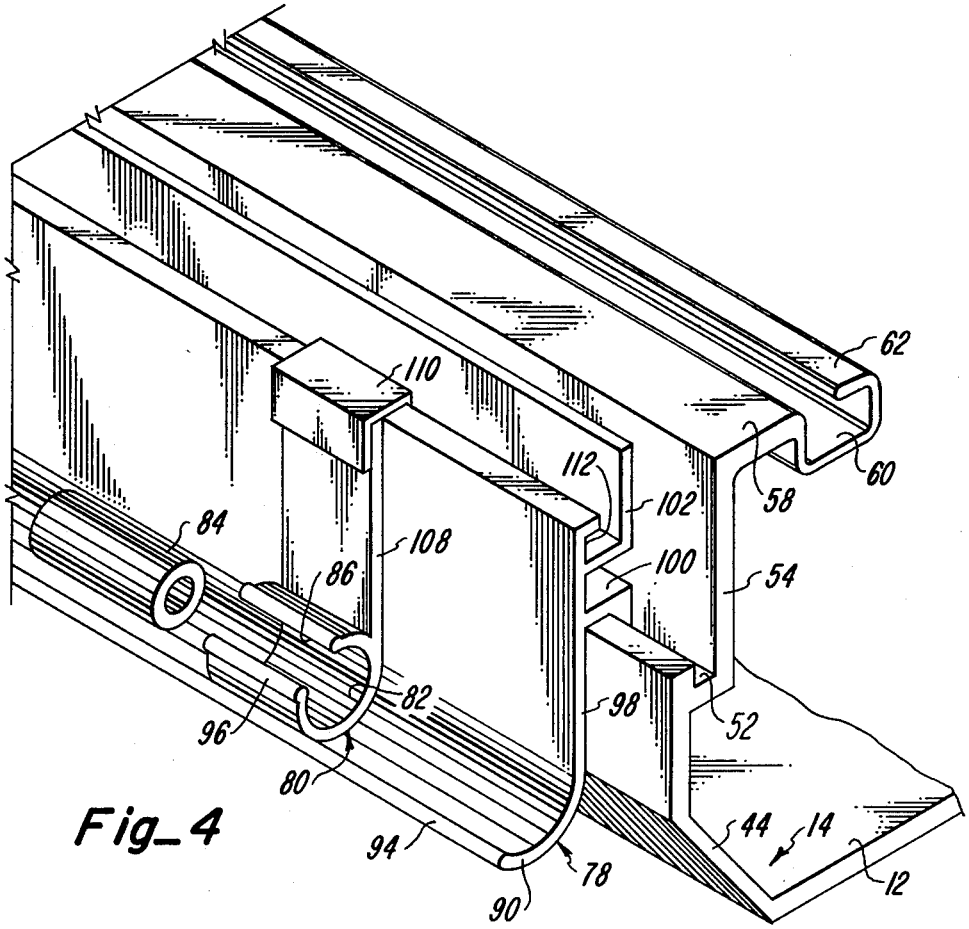
FIG. 4 is an enlarged, fragmentary and partially exploded isometric view, with certain of the components omitted, of the embodiment depicted in FIG. 2.

In one form, both hinge 78 and hinge pin 80 are continuous throughout a margin of the display face. Preferably, and as illustrated in FIG. 4, only hinge 78 is continuous throughout the length of a margin, and hinge pin 80 is comparatively narrow in width, with one inch being exemplary. Consequently, a plurality of hinge pins 80 are successively spaced along the length of that margin, a suitable spacing for a sign of average size being approximately every twelve inches. For larger signs in which greater tension forces are developed, less spacing is preferred. At least for the purpose of saving some in material cost, hinge 78 also could be so divided into such a succession of individual hinges. However, this latter alternative may make it more difficult to properly adjust with respect to freedom from wrinkling, and it also would create a discontinuity in the edge of the field of illumination that otherwise, as noted above, is defined by segment end 94.

In the overall arrangement of the complete sign assembly, and as already mentioned, it is preferred that all four of the support elements be formed to have the same cross section, as by being cut from a common length of stock. They desirably are joined in a mitred condition at each pair of successive ends. That may be achieved either by direct welding of the mitred ends or by the use of internally disposed right-angled brackets heliarc welded or otherwise secured to each of the successive support elements. Analogously, it is preferred that the hinges and hinge pins along all four sides of the display face also be identical, as are all other associated parts. In any case, that identity of parts as around the entire margin is the form of the embodiment disclosed herein.

With the preferred arrangement of continuous hinges 78 and segmental short hinge pins 80, and also after temporarily removing retainer 64, all four edge margins of fabric 40 are inserted within each of the different hinge pins and around each of the correspondingly different wedges. The free ends of the different marginal portions may be grasped so as to establish enough tension all of the way around the margin that, upon release of the free end of the marginal portion at any one of hinge pins 80, its wedge 84 is drawn within mouth 86 to secure that part of the corresponding marginal portion into a fixed relationship. Perhaps the best way to achieve initial threading and tensioning is to rotate lever 108 forward with the marginal portion of the fabric pressed into mouth 86 so as to be loose within cavity 82. Wedge 84 is then inserted, and lever 108 thereafter is rotated back toward its locked position while the marginal portion is pulled upon to cause the wedge to secure the fabric within the mouth. Thereafter, and preferably working from the center of each marginal portion outwardly as indicated above, the different ones of wedges 84 are successively released at which time that part of the captivated marginal portion is pulled further through cavity 82 in order to increase tension in fabric 40, while at the same time being moved sideways any slight amount necessary to remove wrinkles. After each adjustment, the tension in fabric 40 keeps the wedge drawn into the associated mouth to secure the contained fabric into a fixed position.

To free each wedge from its securing position, it would only be necessary in the preferred embodiment for the installer to grasp the opposing ends of the wedge between his thumb and forefinger and thereby urge the wedge inwardly. Similarly, the wedge could be urged inwardly by means of the point of an implement inserted through mouth 86. Although it would seem to be unnecessary except possibly in the case of a very long hinge pin and corresponding wedge, the wedge or a member affixed to an end thereof could extend outwardly beyond the length of its hinge pin 80 so as to permit manipulation of the wedge to loosen it from its secured position. That approach even could include an eccentric mount at opposite ends of such a wedge and operable to move the wedge into and out of mouth 86.

However, the arrangement of the embodiment of FIG. 2 includes further features which negate the need for such possible modifications as have just been suggested except possibly in unusual cases. In this connection, it is only necessary to remove keeper 110 in order to be able to rock lever 108 back and forth and between the limits already discussed. At any one hinge pin 80, the part of the marginal portion contained therein may be slackened simply by pulling lever 108 forwardly and away from finger 98. That serves to release the securing action of wedge 84 and permit fabric 40 to be adjusted at that location. At the same time, it permits a new "bite" to be taken so that, upon swinging lever 108 backwardly to again position it against finger 98, the tension in fabric 40 is increased. In this manner, a ratchet-type action may be obtained by successively swinging lever 108 back and forth and correspondingly with that motion causing release and thereafter re-engagement of wedge 84 in sequence therewith. When the desired tension has been achieved at the one of hinge pins 80 being so manipulated, at least for the present, keeper 110 is slid into place so as to thereby lock hinge pin 80 into its limit position with lever 108 disposed against finger 98.

It should be noted that wedge 84 may have other than a cylindrical cross section in order to increase the degree of its wedge action. In any case, its exterior surface may be serrated to increase its gripping function as may the interior surface of hinge pin 80. Also, wedge 84 may be fabricated from wood, metal or other material. Nevertheless, in using the described PANAFLEX fabric, fully satisfactory performance has been indicated with wedge 84 fabricated simply as a smooth-finished wooden dowel and with cavity 82 also presenting a smooth surface.

Other modifications also may be desired. As used on a vertical side margin of the display face, for example, it is preferable that each keeper 110 be constrained from moving downward by gravity as might occur in the presence of vibration. To that end, a fine wire may be looped around each such clip and secured at each end by a screw or other fastener. Alternatively, the free end portion of lever 108 may be slightly extended and bifurcated so as to receive and captivate a keeper 110 modified so as to be that much less in width.

In practice, it is expected that the width of hinge pin 108 usually will vary between a little less than one inch and perhaps three inches. It will be observed that an increase in the radius of the hinge and hinge pin will result in obtaining a greater degree of tensioning action with each ratchet-like operation of lever 108. Of course, the greater the tension that has been induced, the tighter the clamping action imposed by wedge 84. If desired in order to lock wedge 84 in place after all tensioning has been completed, a thin tapered member may be placed in the bottom of cavity 82 so as to make it impossible for the wedge to move inwardly from its secured position within mouth 86.

Figure 3:
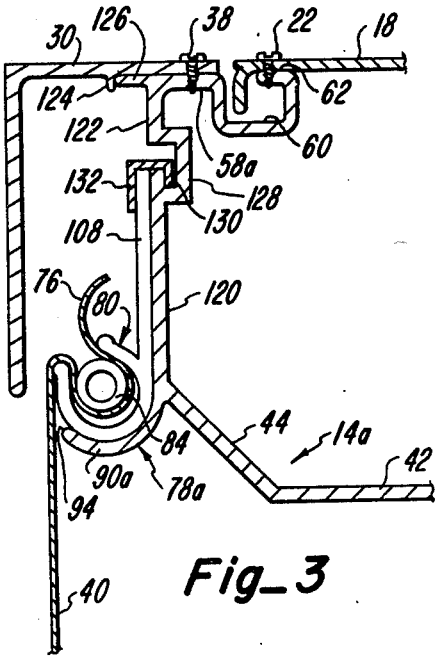
FIG. 3 is a view similar to FIG. 2 but illustrating modifications of different ones of the various components.

As already indicated, the particular form of hinge 78 shown in FIG. 2 permits implementation of the present mounting system to support elements of a form basically as shown in the cross-referenced patent. In principle, hinge 78 may be extruded or otherwise formed to include members of whatever shape is required to interfit with or attach to a framework support element of any kind of exterior configuration. FIG. 3, however, represents one particularly favored version which uses a newly devised support element **14*a* that is shaped to take advantage of features present in the pre-existing form of support element 14 as shown in FIG. 2 and also to accommodate the mounting system principles as explained in connection with FIG. 2**.

To this end, element **14*a* again is shaped generally as an outwardly-opening U-shaped channel, so as to include a bottom wall 42 that merges into an upwardly sloping wall portion 44. The latter continues into a lower side wall portion 120 and then an upper side wall portion 122 which turns into a shelf 58*a* and thereafter defines a cavity 60 and another shelf 62 to which access cover 18 is affixed by screws 22. Retainer 30 is of L-shaped cross section and includes a downwardly projecting lug 124 that comes into alignment against a lip 126 which projects outwardly from upper wall portion 122. Between side wall portions 120 and 122 is an inwardly inset additional side wall portion 128 shaped to define a recess 130 in which is seated one leg of a downwardly-facing U-shaped keeper 132. In a modification, recess 130 may be shaped and oriented like recess 112 in FIG. 2, so as to permit use of keeper 110 of that version. This permits the economy of using a standard part for both arrangements. Moreover, the additional cleat portion on keeper 110** tends to achieve a more secure interlock.

In the embodiment of FIG. 3, hinge 80 and wedge 84 are the same as those parts of FIG. 2, so as also to have leg 108. Accordingly, keeper 132 serves to secure lever 108 in a fixed position at one limit of rotation of hinge pin 80. In this case, however, what was finger 98 in FIG. 2 is merged into side wall portion 120 so as to be one and the same. At the same time, hinge **78*a* includes a segment 90*a* which projects integrally away from support element 14*a* at the junction between sloping panel 44 and side wall portion 120. Segment 90*a* continues around hinge pin 80 a distance less than one half the circumference thereof and again terminates in an end 94 that has the same functions as before. It will be immediately apparent that installation and adjustment of fabric 40 in the embodiment of FIG. 3 may proceed in exactly the same way as described above for the embodiment of FIG. 2**.

Figure 5:
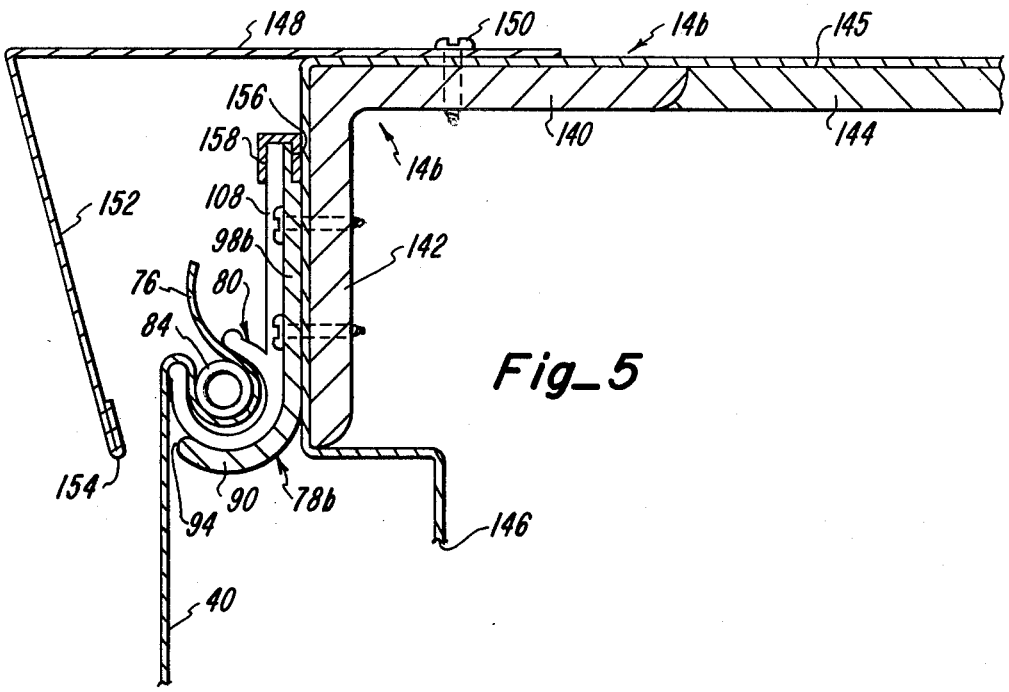
FIG. 5 is a view similar to FIGS. 2 and 3 but showing another embodiment of various components.

As mentioned above, numerous sign assemblies exist and others are still being constructed which utilize steel angle irons or the like to form and define the basic cabinet. FIG. 5 illustrates an embodiment modified to permit adaptation to a typical cabinet fabricated in that manner. Thus, a support element **14*b* includes an angle iron 140 one leg 142 of which is oriented to define a side wall of the interior channel. Angle iron 140 may be welded to a cross plate 144 which connects to a similar angle iron at the other side. An exterior sheet metal skin 145 covers cross plate 144 and angle iron 140, is bent inwardly, and then continues on downwardly at the lower margin of angle iron 140 so as to define an edge 146 of an illuminated area. One end portion of a retainer 148 is secured through skin 145 to angle iron 140 by a screw 150 and continues on outwardly until bending back to define a downwardly and backwardly sloping panel 152 crimped at its lower end 154** in order to form a re-enforcing rib. Often, another steel cross plate is disposed between the side walls to provide added strength and a mounting for lamp sockets.

Once more, hinge pin 80 and wedge 84 are identical in form to those elements as shown in FIG. 2. In this case, hinge 78*b* includes an also identical segment 90 which terminates in a free end 94 and at its other end continues into a finger 98*b*. Finger 98*b* is the same as finger 98 in FIG. 2 except for the provision of a cutout 156 defined in the outer end portion of finger 98*b* and on the side thereof that is held against skin 145 by screws as shown. Lever 108 of hinge pin 80 is secured in one limit position against finger 98*b* by a downwardly-facing U-shaped clip 158 which has one leg seated in cutout 156 and extends around the free end portions of lever 108 and finger 98*b*. As in the embodiment of FIG. 3, the mounting and adjustment of fabric 40 may be exactly the same as already described for the embodiment of FIG. 2.

In contrast with the embodiments shown in FIGS. 2–5, wherein portions of the resultant assembly include members or portions either identical or at least similar in principle to previously known configurations, the embodiment shown in FIG. 6 is entirely new except for the illustrated fluorescent lamp 170, its sockets 172 and the mounting for those sockets. In this case, a support element 14*c* is an aluminum extrusion that again defines internally a U-shaped channel but which in this case opens inwardly of the ultimate sign cabinet. Thus, the extrusion includes an upper wall 174 joining space-opposed side walls 176 and 178. Displaced a short distance below upper wall 174 are an opposed pair of facing lugs 180 and 182.

Once again, it is not necessary that the side and lower support elements of the main framework be identical in shape to upper support element 14*c*. For convenience and economy, however, that is the case in the embodiment of FIG. 6. Thus, wall 174, which is the upper wall of upper support element 14*c*, becomes the bottom wall of the framework when inverted and appropriately spaced apart. The side support elements of the resulting framework also are cut from the same extruded stock, and all of the different support elements are joined successively end to end so as to define the ultimate cabinet. In this case, lugs 180 and 182 serve to define recesses in which appropriate steel or aluminum corner angles preferably are received and bolted or heliarc welded to the respective support elements so as to form strong, rigid corners of the framework. In addition, steel plates are of an appropriate width to slide under lugs 180 and 182 along the bottom and top margins after which they are bolted in place. Later, a steel pipe or tube is inserted through an opening in the bottom support element and that plate to dispose its upper end against the steel plate mounted to the top support element. The pipe is then welded to both steel plates and subsequently serves to connect the entire display sign upon the upper end of post 12 or to an equivalent support.

Projecting inwardly from about the midportion of side wall 176 are a pair of vertically spaced lugs 184 and 186 with lug 186, closest to lamp 170, having a length shorter than lug 184. Spaced opposite lugs 184 and 186 is an inwardly projecting shelf 188. During assembly, one edge margin of a plate 190 is inserted between lugs 184 and 186 after which its other edge margin is swung toward and against shelf 188 against which it is secured in place by means of a screw 192. Plate 190 thus defines a removable access cover and contains suitable apertures within which the lamp sockets 172 are mounted and captivated. Screws 192 or equivalent fasteners are required only along one margin of plate 190, thereby reducing labor otherwise required to drill and fasten the other margin.

Outer wall 174 continues beyond each of side walls 176 and 178 so as to define respective projecting lips 194 and 196 each of which is forked at its outer end portion 198. Seated within each of forks 198 is the shorter leg of an L-shaped retainer 200 the longer leg of which projects toward the display face.

Each of side walls 176 and 178 of upper support element 14*c* continues beyond shelf 190 as a finger and turns smoothly outward to define a hinge 202 against the inner surface of which is nested a hinge pin 204. In itself, hinge pin 204 is of C-shaped cross section so as to define a mouth 206 of an interior cavity within which is captivated a wedge 208. As before, the adjacent marginal edge portion 210 of fabric 40 is threaded into mouth 206 and around wedge 208 after which it emerges from the other side of the mouth.

In this case, hinge 202 has a segment 212 which presents a concave interior surface so as to serve the same purpose as segment 90 in FIG. 2 but which herein embraces in excess of one half the distance around hinge pin 204, so that the latter may be captivated within segment 212. Segment 212 terminates in a rounded shoulder 214 that defines, with the opposite finger 216, a gap which has a width that permits snug entry of hinge pin 204. Because shoulder 214 projects upwardly beyond the axis of hinge pin 204, tension induced in fabric 40 forces the hinge pin to remain seated in hinge 202.

A lip 218 is integrally affixed at one end to and projects away from hinge pin 204 from the side of mouth 206 more distant from finger 216. Projecting outwardly from hinge 202 at shoulder 214 is a flange 220, the free end portion 222 thereof being turned inwardly toward the lower framework support element. Lip 218 projects outwardly from hinge pin 204 in a direction away from support element 14*c* a distance greater than the distance by which flange 220 projects away from that support element. That is, the free end of lip 218 is spaced beyond the free end of flanges 220. Moreover, the outer or free end portion of lip 218 is also bent toward the lower or opposite framework support element. Fabric 40 continues from marginal portion 210 as a skirt portion 224 that further continues into a central portion 226. Thus, skirt portion 224 lies adjacent to the side of lip 218 opposite flange 220, and central portion 226 is directed toward the lower support element.

As particularly embodied in FIG. 6, the opposite and lower support element includes a fastener 230 for the opposed marginal portion 232 of fabric 40. Fastener 230 includes an L-shaped bracket 233 the longer leg of which in use is abutted against side wall 176 and its continuation as finger 216. The shorter leg of bracket 233 continues outwardly away from the support element into a lip 234 that overlies flange 220. The outer or free end portion of lip 234 projects away from the lower support element a distance greater than the outer end of flange 220 and is turned in this case upwardly toward the upper support element and central portion 226 of fabric 40. When assembled, the longer leg of bracket 233 is secured to side wall portion 176 by a screw 238. Thus, screw 238 also serves to removably affix lip 234 indirectly to the lower support element.

Also included in fastener 230 is a removable resilient clip 240 which is shaped to clamp a captured marginal portion of fabric 40 to lip 234. To that end, lip 234 is formed to define a latch surface on the free end of a stub 242 and which is lockingly engageable with a latch member 244 defined in clip 240. A part of marginal portion 232 is clamped between that latch surface and that latch member, so that marginal portion 232 is secured to lip 234. Thus, marginal portion 232 is then fixed into position with respect to the lower support element.

Clip 240 is shaped further to define another latch member in the form of a C-shaped end portion 246 which is disposed to embrace a rounded terminal portion 248 defined on the outer end of a strut 250 that projects away from bracket 233 and outwardly from the lower support element as well as in a generally downward direction. Marginal portion 232 of fabric 40 is also clamped between latch member portion 246 and the latch surface defined by rounded terminal portion 248. Terminal portion 248 is another form of hinge pin, while end portion 246 serves as a hinge. In use, clip 240 is placed against the outside of marginal portion 234 at a desired distance from the free edge of the marginal portion. End portion 246 is then placed over terminal portion 248 with the fabric therebetween. Clip 240 thereafter is rotated around terminal portion 248 until latch member 244 is snapped into engagement with the latch surface on stub 242 to complete the clamping of the fabric in place. As clip 240 is rotated around terminal portion 248, tension is induced in fabric 40.

In a completed sign assembly, the remaining pair of support elements, which serve as the vertical side margins, preferably also include fasteners 230 arranged in the same manner. As illustrated, lip 234 projects outwardly from the lower support element and in a direction that is generally lateral to the resulting display face. Fabric 40 continues from its lower marginal portion in FIG. 6 again as a skirt 224 which continues into central portion 226 with skirt 224 lying against the side of lip 234 opposite upper support element 14c.

Flange 220 also projects outwardly from the lower support element in a direction generally laterally to the ultimate display face and is disposed on the side of lip 234 toward upper support element 14c. With fabric 40 stretched in tension, lip 234 is slidable over flange 220 which cams lip 234 into a position whereat the lip is affixed indirectly to the lower support element by means of bracket 233. It will, of course, be noted that flange 220 projects directly away from what constitutes hinge 212 in upper support element 14c. When segment 212 need not be included in which case flange 220 could project directly away from finger 216.

Upon whichever support element fastener 230 is used, it preferably is employed with a plurality of clips 240 which are successively spaced along that support element. In use, clips 240 are thus removable at any location along a margin of the display face, so as to permit the adjustment of tension in fabric 40 as well as movement of different parts of the associated marginal portion of that fabric for the purpose of adjusting against wrinkling. That is, selected sections of a marginal portion may be moved in a direction along the length of the corresponding support element as necessitated.

Thus, the entire fastening assembly includes a plurality of lips 218 and 234 that fasten corresponding ones of the different marginal portions of fabric 40 to respective ones of the support elements, the fabric continuing from each of the different marginal portions as a skirt that overlies the corresponding one of the lips and further continuing around the free end portion of that lip into a common central portion. Another function of the outer end portions of lips 218 and 234 is to space central portion 226 of each display face the correct distance from lamps 170 as discussed above for the purpose of obtaining uniformity of illumination while yet avoiding the need for provision of support elements of any greater width.

In the preferred arrangement of all of the components shown in FIG. 6, all of those lips 218 and 234 are continuous and are joined in succession one to the next to define a frame 260 that it matable with the framework formed by the succession of support elements. The various flanges 220 also are included all of the way around the perimeter of the display face, and each is disposed on the side of its corresponding lip opposite skirt 224. With the corresponding marginal portions individually fastened to respective different ones of the lips and fabric 40 stretched under tension on frame 260, hinge pin 204 is set into hinge 202 along the upper support element. Of course, all of retainers 200 on that face side are at this time removed. The bottom margin of frame 260 is then swung toward the lower support element. During that movement, flanges 220 on the lower and side support elements cam the entire frame into a position adjacent to the framework.

During mounting of frame 260, flange 220 along the upper support element may assist in the operation by at least guiding hinge pin 204 toward its seat within hinge 202. Should it for any reason be desirable to seat hinge pin 204 in hinge 202 at the same time as or after the placement of the remainder of frame 260 against the lower and side support elements, flange 220 along the upper support element is so shaped and oriented that it will cam hinge pin 204 into the position necessary to drop into hinge 202. In any case, either the disposition of hinge pin 204 within hinge 202 or the affixation of bracket 233 against its associated support element serves to secure frame 260 to the main framework. Moreover, the use of hinge pin 204 and hinge 202 along upper support element 14c permits the entire top margin of frame 260 to be hingedly secured along that upper margin of the main framework. In that aspect, the securement provided by bracket 233 or the equivalent serves to hold frame 260 in closing relationship with the framework.

In the preferred mode of installation, frame 260 is formed by joining together the different lips 218 and 234 before deliverly to the work site. The joinder of the successive ends of lips 218 and 234 in order to form frame 260 may be made directly by heliarc welding and with no need for additional corner supports. After the frame is formed, fabric 40 may be mounted upon frame 260 with only a sufficient degree of tension therein to hold the fabric in place on the frame. With the main framework or cabinet already installed, the thus assembled frame with fabric 40 mounted is then slipped over the combination of all of flanges 220 as described above. If necessary to overcome the initial tension induced in fabric 40, and with hinge pin 204 first seated in hinge 202, a longer form of screw 238 may be used to draw lower lip 234 over its lower flange 220 until the longer leg of bracket 233 is disposed against the lower support element. Then, different ones of the succession of the longer form of screws 238 are removed and replaced by the shorter screws so that their inner ends will not penetrate into the wiring. Accordingly, the final form of screws 238 ultimately serve to secure the entire frame to the framework defined by the different ones of the support elements.

After completing the installation of frame 260, and if necessary, the upper marginal portion 210 of fabric 40 desirably is first adjusted, by loosening wedge 208, to what is to be the final position of that marginal portion. Preferably, that already has been done before delivery of frame 260 to the work site. Thereafter, individual different ones of clips 240 are unlatched and that part of lower marginal portion 232 is then adjusted laterally to smooth out wrinkles and also to eventually reach the finally desired tension in fabric 40. After each such incremental adjustment of a given section of lower marginal portion 232, the one of clips 240 overlying that section is again snapped into place after which the next one of the clips is removed so that its section of the lower margin may be adjusted. The very same procedure is employed along the vertical side margins of the display face. In reaching final tension adjustment, the installer preferably alternates between adjustment in the horizontal direction and adjustment in the vertical direction.

To assist in obtaining the correct amount of tension ultimately induced in fabric 40, a line preferably is defined, either temporarily by the use of chalk or permanently by printing, across the exterior surface of fabric 40 and parallel to what will be a nearby support element. Such a line should be defined adjacent to at least one horizontal support element and one vertical support element, although it may be defined all of the way around the perimeter. For illustration, that line will be discussed in connection with fastener 230 along the lower margin.

Accordingly, a specific location on fastener 230 is selected as a reference point. Conveniently, that may be at the bend 264 between latch members 244 and 246. The line which is defined on the exterior surface of fabric 40 initially is located in a position exposed to view from the front exterior of the display face when the tension in fabric 40 is substantially removed. On the other hand, location of the line is such that, upon increasing the tension in fabric 40, the line is moved toward the reference point defined by bend 264. Accordingly, the line is so located relative to lower marginal portion 232 at its outer end that, upon achieving the tension ultimately desired, that line has been moved into a final position against bend 264. At that point, clip 240 may be latched into place for the final time. Thereafter, access to the interior of the sign cabinet requires only the removal of screws 238 along the bottom and side margins. This permits frame 260 to be swung out from the bottom and in hinge 202 without disturbing the tension established in fabric 40.

A leading attribute of the embodiment of FIG. 6 is that the definition of skirt 224 entirely around the perimeter of central portion 226 of the resulting display face serves to give the appearance of the "molded pan look" discussed earlier. In a modified version, which would be simpler although not nearly as flexible in usage, flanges 220 may be merged into lips 218 and 234 to provide only one skirt-defining and outwardly projecting pan-forming member. This is not as desirable, however, because the separate existance of flanges 220 serves as additional support for lips 218 and 234. Because of flanges 220, frame 260 may in itself be of a more lightweight construction. In that connection, the initial tensioning of fabric 40 at the time of its first mounting upon frame 260 tends to create an inward bow in lipw 218 and 234. However, and as a result of camming the lips over different ones of flanges 220 and the straight edges defined by hinge 202 and all flanges 220, that bow is removed as frame 260 is urged into its final mounted location.

As an alternative to the formation and use of frame 260, either lips 218 or 234 and their respective components may be used independently along any given support element similarly to the use of independent hardware in the embodiments of FIGS. 2–5. Lip 218 in that case serves as a lever similar in fucntion to lever 208 although of somewhat different shape and projecting from the opposite side of the mouth of the hollow hinge pin. At the same time, flange 220 constitutes a stop carried by support element **14*c* and which is disposed in the path of lip 218 to define a limit of rotation of hinge pin 204. When in place, the lower end of the longer leg of retainer 200 would constitute a stop disposed in the swing path of lip 218 so as to define another limit to the rotation of hinge pin 204. For the more significant functional purpose in this alternative of permitting the rocking of lip 218 with retainer 200 temporarily removed, to adjust position of marginal portion 210 and tension in fabric 40, it is the outer end of the nearby one of forks 198 which serves as the other rotational limit of hinge pin 204**.

With fabric 40 under tension in this independent alternative and hinge pin 204 initially located apart from hinge 202, flange 220 agains is oriented to defined a cam surface over which hinge pin 204 may be slid and then inserted around shoulder 214 and into hinge 202. That same tension already induced in fabric 40 also serves to lock hinge pin 204 against rotation by constraining lip 218 to lie against flange 220. For this purpose, hinge 202 preferably is continuous over its length along support element **14*c* as is hinge pin 204. Otherwise, at least hinge pin 202 and wedge 208 may be in successive segments as in the version of FIG. 2. It will be apparent that initial installation of fabric 40 in this case may proceed on the same basis as described in connection with FIG. 2. That is, marginal portion 210 may be first inserted around wedge 208 after which lip 218 is rocked back and forth in a ratchet-like fashion with a related acton upon wedge 208 or in a manner otherwise to use lip 218 to slacken the tension and thereby permit adjustment of marginal portion 210. In the same manner, one or more of the other support elements may be used like upper support element 14*c* so as to include hinge 202 and be associated with hinge pin 204 and wedge 208. On the other hand, fasteners 230 may be used with any support element to serve as means for adjusting tension in fabric 40**.

Figure 7:
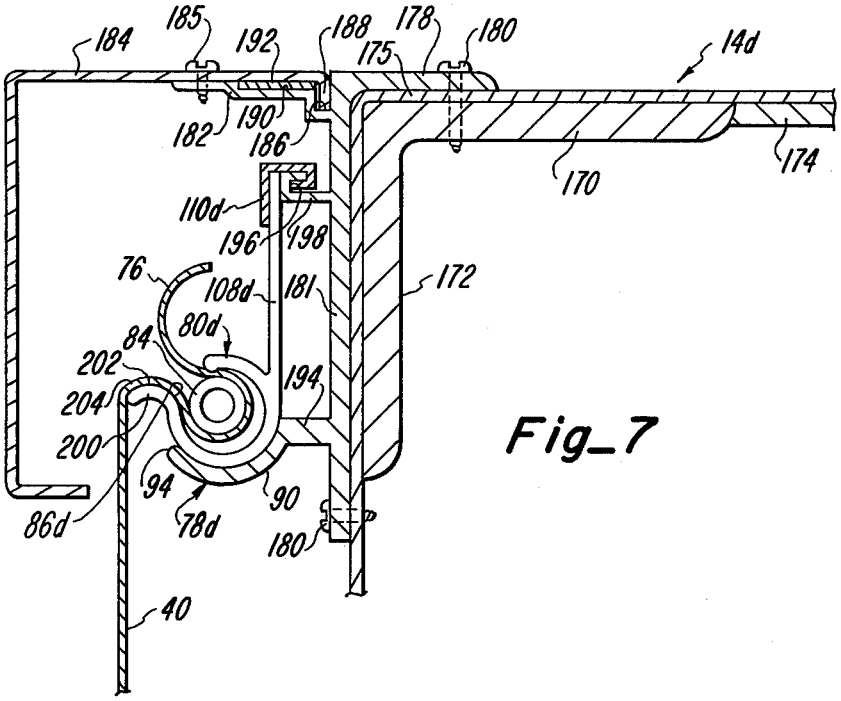
FIG. 7 is a view similar to FIG. 5 but showing yet another embodiment of various components.

Finally, FIG. 7 shows still another embodiment which is particularly useful with either existig sign cabinets or new cabinets of the same conformation. Like in FIG. 5, the cabinet is basically of rectangular cross section and in this case also has a framework made from steel members. Thus, a support element **14*d* includes an angle iron 170 one leg 172 of which is oriented to define a side wall of an interior channel. Angle iron 170 is welded to a cross plate 174 which connects to a similar angle iron at the other side. An exterior sheet metal skin 175 covers angle iron 170 and cross plate 174** and extends on inwardly of the angle iron.

An L-shaped extruded bracket 178 fits over skin 175 and around angle iron 170, being secured to the latter by screws 180. Projecting outwardly from near the upper end of the longer leg 181 of bracket 178 is a shelf 182 to which a retainer 184 is secured by screws 185. Shelf 182 is shaped at its inner end to define a recess 186 in which a down-turned margin 188 is seated. A ledge 190, also defined in shelf 182, accommodates a gasket 192. At its outer end, retainer 184 is bent downwardly and thereafter reversely to define a concealing border.

Projecting outwardly from near the lower end of leg 181 is a strut 194 which continues into a hinge **78*d* again having a segment 90 with a free end 94. A hinge pin 80*d*, similar to hinge pin 80 and nested in hinge 78*d*, has a lever 108*d* that may be locked in a vertical position by a keeper 110*d*. For ecomony when to be used also with other support elements, keeper 110*d* may be identical to keeper 110 of FIG. 2. Thus, keeper 110*d* is shaped to bend around the outer end of lever 108*d* and terminates in a re-entrant portion that seats in a recess 196 defined in a J-shaped stub 198 which projects outwardly from leg 181 between shelf 182 and strut 194. When locked by keeper 110*d*, the free end portion of lever 108*d* abuts the outer end of stub 198**.

At the side of mouth **86*d* opposite lever 108*d*, the wall of hinge pin 80*d* continues into a lip 200 that projects on outwardly in the direction away from support element 14*d*. Lip 200 curves smoothly to present an upwardly-facing convex surface 202 and terminates in a free end which is spaced outwardly beyond end 94. Upon removal of keeper 110*d*, lever 108*d* may be moved forwardly to rotate hinge pin 80*d* until lip 200 abuts end 94** as a limit of rotation.

As shown, wedge 84 is disposed within hinge pin **80*d* to function in some manner discussed above. Thus, the mounting and adjustment of fabric 40 may be exactly the same as described in connection with the embodiment of FIG. 2. In FIG. 7, however, lip 200 also serves a function analogous to a feature of lip 218 in FIG. 6. That is, marginal portion 76 continues into a skirt portion 204 that overlies surface 202 on lip 200** before the fabric turns downward to define the illuminated display face.

By virtue of the provision of lip 200, the display face is spaced farther from the main framework of the cabinet than in the embodiments of FIGS. 2–5. In retrofitting an existing cabinet, that may be desirable to improve overall appearance or to obtain better uniformity of illumination in the manner explained above. If made to be sufficiently rugged, lip 200 could, in principle, be extended so as also to yield a "pan shaped look" to the display face. However, it appears to be preferable to achieve that result by the use of the arrangement of FIG. 6 wherein lip 218 is supported on flange 220, adapting that approach as necessary to accommodate either an existing sign cabinet when retrofitting or a new cabinet of still different cross-sectional shape.

In the case of all embodiments, it has been explained that one purpose of being able to release at least some tension in different sections of a marginal portion is to allow smoothing of fabric 40 so as to remove wrinkles. Particularly with a pictorial display printed upon the display face, it might actually be desired in a specific case that a certain amount of wrinkling in a selected portion of the display face be caused to occur deliberately for the purpose of modifying the image visualized by a limited shadowing or other effect. Of course, the adjustable fastening and hinging devices described permit that result.

As illustrated herein, the overall assembly has always been presented in rectangular form. In practice, the different support elements often are of sufficient length that they may be curved so as to bow outwardly at their centers and thereby define a curved margin of the display face. In that case, each of hinge pins 204 or clips 240 is sufficiently narrow that it still may be shaped to define surfaces across its width that are straight. Alternatively, a curved margin may be caused to appear by mounting a bezel around the perimeter of the display face which in itself has a straight mounting member but with the bezel defining an illuminated area as viewed which has a curved margin. Such a bezel may be part of an extension of the retainer. As a further alternative, the inwardly directed and free end of one or more of lips 218 and 234 may be curved so as to define an illuminated margin of that shape. In any event, any such addition of a curved or other marginal feature might also include different formations such as scallops.

As mentioned, the specific embodiment of FIG. 6 is essentially a new version and features integration of flange 220 and hing 202 into the corresponding support element of the primary framework. While that definitely is the preferred approach, it should be apparent that flange 220 and hinge 202 may alternatively be joined to a separate member fully analogous to finger 98 of FIG. 2 or finger **98*b* of FIG. 5. Thus, there would be a separate part securable to the side wall of a new or an existing older form of main framework support element in the same or an equivalent manner to that discussed in connection with FIGS. 2 and 5. In this way, older forms of support elements may be retrofitted to adapt the improvements featured in FIG. 6 such as the attainment of the "molded pan look" and/or the separate formation of frame 260** that is hingeably secured along one margin of the framework.

It will thus be seen that the different embodiments described and illustrated take advantage of many desirable features that are present in existing sign display assemblies while yet avoiding numerous disadvantages thereof. Of leading importance, the new approaches permit improved mounting of stretchable fabric display faces. Better hardware is provided for adjusting position of and tension in the fabric, and there is no need to make mounting holes in the material.

With the present techniques, it is easy to obtain incremental adjustment of tension and in control of wrinkles. All versions may be either routinely adapted to existing sign frameworks or incorporated integrally into new frameworks. Resulting sign assemblies can withstand hurricanes and still be reasonable in terms of cost for material and labor.

In any case, the display face may be swung or otherwise moved away from the framework to allow access to the interior. With use of a separate frame as described in connection with FIG. 6, the entire, display face may be swung away without disturbing the previous adjustment of tension and smoothness. While mechanical distortion and wind damage must be avoided, the overall construction permits the use of a separate frame that in itself is lightweight.

Existing signs may be retrofitted in the field without having to dismount their cabinets. Whether the framework is new or old, the amount of field work is minimized. That is particularly appreciated when the signs are very large or mounted high above the ground.

The different versions and the several modifications available for each permit satisfaction of a variety of user requirements and preferences. Perhaps the leading preference accommodated is that for the "molded pan look". The same approach also enables uniform illumination even though the cabinet is comparatively narrow.

While particular embodiments of the invention have been shown and described, and a number of different modifications and alternatives have been presented, it will be obvious to those skilled in the art that changes and further modifications may be made without departing from the invention in its broader aspects. Therefore, the aim in the appended claims is to cover all such changes and modifications as fall within the true spirit and scope of the invention.

I claim:

1. A display sign comprising:

a sign framework having spaced upper and lower elongated support elements joined between corresponding opposite ends thereof by respective spaced elongated side support elements;

a stretchable fabric display face disposed across the space defined by said framework;

a hinge affixed to at least one of said support elements;

a hinge pin mated within said hinge to rotate therein;

means for limiting said hinge pin in extent of rotation within said hinge pin;

and means for coupling to said hinge pin one marginal portion of said fabric.

2. A display sign as defined in claim 1 in which said hinge pin is hollowed out to define an inner wall that defines a cavity and that merges into an outwardly facing mouth having a width smaller than the width of said cavity, and in which said coupling means includes a member captured within said cavity by said mouth.

3. A display sign as defined in claim 2 wherein said marginal portion leads into and out of said mouth and is partially wrapped around said member to reside between said member and said inner wall, and wherein said member has a size and shape to fit loosely within said cavity but tightly within said mouth to wedge said marginal portion against the inner surface thereof.

4. A display sign as defined in claim 1 in which said coupling means is adjustable between a first condition wherein said marginal portion is fixed in position relative to said hinge pin and a second condition wherein said marginal portion is movable relative to said hinge pin and in which said coupling means includes an element for wedging said marginal portion to said hinge pin upon adjustment of said coupling means into said first condition.

5. A display sign as defined in claim 1 in which said hinge include a segment shaped to encircle a portion of said hinge pin and in which said hinge pin presents a surface nested within said segment.

6. A display sign as defined in claim 5 in which said segment embraces less than one-half the circumferential distance around said hinge pin.

7. A display sign as defined in claim 5 in which the concave surface of said segment faces away from the central portion of said display face, in which said fabric continues away from said hinge pin and said marginal portion directly into said central portion, and in which an end of said segment is disposed adjacent to but spaced from said fabric.

8. A display sign as defined in claim 1 in which a source of illumination is disposed within said framework on the interior side of said display face, and in which said end of said segment defines an edge of the area of illumination of said central portion by said source.

9. A display sign as defined in claim 5 in which said segment embraces in excess of one-half the distance circumferentially around said hinge pin and in which said hinge pin is captured within said segment in response to tension induced in said fabric.

10. A display sign as defined in claim 1 in which said limiting means is disposed to restrict the amount of rotation of said hinge pin to a fraction of one revolution.

11. A display sign as defined in claim 1 which includes a finger affixed to and projecting laterally outward away from said hinge and means for securing said finger to said one support element.

12. A display sign as defined in claim 11 in which said finger is integrally joined at one end to said hinge.

13. A display sign as defined in claim 11 in which a lever is affixed at one end to and projects laterally outward away from said hinge pin, in which said lever lies alongside said finger to define one limit of rotation of said hinge pin, and which includes means to secure said finger to said lever.

14. A display sign as defined in claim 13 which includes a keeper engageable around the free ends of said lever and said finger.

15. A display sign as defined in claim 13 in which said finger is shaped to define a recess, and which includes a keeper engaged in said recess and to said finger.

16. A display sign as defined in claim 1 in which an integral portion of said one support element is shaped to define said hinge.

17. A display sign as defined in claim 1 in which a lever is affixed at one end to and projects laterally away from said hinge pin.

18. A display sign as defined in claim 17 in which said lever lies alongside a surface on said one support element to define one limit of rotation of said hinge pin.

19. A display sign as defined in claim 18 in which said limiting means includes a keeper engageable between said lever and said one support element.

20. A display sign as defined in claim 19 in which said one support element is shaped to define a recess and in which said keeper includes a portion seated in said recess.

21. A display sign as defined in claim 17 in which said one end of said lever is integrally joined to said hinge pin.

22. A display sign as defined in claim 17 which further includes a stop carried by said one support element and disposed in the path of said lever to define a limit of rotation of said hinge pin.

23. A display sign as defined in claim 17 in which said lever projects laterally outward from said hinge pin in a direction laterally away from said one support element.

24. A display sign as defined in claim 23 which further includes a flange carried by and projecting outwardly from said one support element in a direction laterally away therefrom.

25. A display sign as defined in claim 24 in which said flange is affixed at one end to said hinge.

26. A display sign as defined in claim 1 which further includes means for locking said hinge pin against rotation at one limit of rotation thereof.

27. A display sign as defined in claim 1 in which said hinge includes a segment that encircles said hinge pin by more than one-half the circumferential distance therearound to define a gap having a width to snugly receive said hinge pin and in which said hinge pin is captured by said segment in response to tension in said fabric.

28. A display sign as defined in claim 29 in which said hinge pin is of C-shaped cross section to define a mouth which faces away from said segment.

29. A display sign as defined in claim 1 in which said hinge is continuous along the length of said one support element.

30. A display sign as defined in claim 1 which includes a plurality of said hinges successively spaced along the length of said one support element.

31. A display sign as defined in claim 1 in which said hinge pin is continuous along the length of said one support element.

32. A display sign as defined in claim 1 which includes a plurality of said hinge pins successively spaced along the length of said one support element.

33. A display sign as defined in claim 1 which further includes means, affixed to another of said support elements spaced opposite said one element, for fastening another marginal portion of said fabric, spaced opposite said one marginal portion, to said other support element.

34. A display sign as defined in claim 33 in which the remaining pair of support elements each include means for fastening an individual one of the remaining marginal portions of said fabric to a corresponding one of said remaining support elements.

35. A display sign as defined in claim 34 in which each of said fastening means includes means for adjusting tension in said fabric.

36. A display sign as defined in claim 33 in which said fastening means includes means for adjusting tension in said fabric.

37. A display sign as defined in claim 33 in which a lip projects laterally outward away from said other support element in a direction generally lateral to said display face.

38. A display sign as defined in claim 37 in which said fabric continues away from said other marginal portion as a skirt that continues into a central portion with said skirt lying against the side of said lip opposite said one support element.

39. A display sign as defined in claim 38 in which a flange projects laterally outward from said other support element in a direction generally lateral to said display face and disposed on the side of said lip toward said one support element.

40. A display sign as defined in claim 37 in which said fastening means includes a removable clip shaped to clamp said other marginal portion to said lip.

41. A display sign as defined in claim 10 in which said lip includes a latch surface and in which said clip includes a latch member lockingly engageable with said latch surface.

42. A display sign as defined in claim 41 in which said other marginal portion also is clamped between said latch surface and said latch member.

43. A display sign as defined in claim 33 in which said fastening means includes a removable clip shaped to clamp said other marginal portion in a position fixed with respect to said other support element.

44. A display sign as defined in claim 43 in which said fastening means includes a latch surface and said clip includes a latch member lockingly engageable with said latch surface.

45. A display sign as defined in claim 44 which further includes means for hingedly securing said clip with respect to said other support element, said clip thereby being swingable to move said latch member into engagement with said latch surface.

46. A displayy sign as defined in claim 33 in which said fastening means includes a plurality of fasteners successively spaced along said other support element.

47. A display sign as defined in claim 1 in which said hinge pin is of generally C-shaped cross section and in which said coupling means secures said marginal portion within the interior of said hinge pin.

48. A display sign as defined in claim 47 in which said coupling means includes a member disposed within the interior of said hinge pin with said marginal portion being disposed between said member and the inner wall of said hinge pin.

49. A display sign as defined in claim 48 in which said coupling means is adjustable between a first condition wherein said marginal portion is fixed in position relative to said hinge pin and a second condition wherein said marginal portion is movable relative to said hinge pin and in which said coupling means includes a member shaped to wedge said marginal portion against said inner wall of said hinge pin upon adjustment of said coupling means into said first condition.

50. A display sign as defined in claim 48 in which said coupling means includes a cylinder having a crosssectional area less than that of the main portion of said C-shaped cross section but a width greater than the distance between the free ends of said hinge pin at the mouth of said cross section.

51. A display sign as defined in claims 47 or 48 in which said coupling means is adjustable between a first condition wherein said marginal portion is fixed in position relative to said hinge pin and a second condition wherein said marginal portion is movable relative to said hinge pin.

52. A display sign as defined in claim 51 in which said coupling means is formed to adjust from said second condition to said first condition in response to tension developed within said fabric upon stretching thereof.

53. A display sign comprising:

a sign framework having spaced upper and lower elongated support elements joined between corresponding opposite ends thereof by respective spaced elongated side support elements;

a stretchable fabric display face disposed across the space defined by said framework;

a hinge affixed to at least one of said support elements;

a hinge pin mated within said hinge to rotate therein;

means for limiting said hinge pin in extent of rotation within said hinge pin;

means for coupling to said hinge pin one marginal portion of said fabric;

said hinge including a segment shaped to encircle a portion of said hinge pin and said hinge pin presenting a surface nested within said segment;

and said hinge pin including an abutment formed on its outer wall in a position to abut an end of said segment upon rotation of said hinge pin and thereby define a limit for the extent of said rotation.

54. A display sign as defined in claim 53 in which said hinge pin is of generally horseshoe-shaped cross section to define a cavity merging into a mouth that flares apart at its outer end, one side of said outer end defining said abutment.

55. A display sign comprising:

a sign framework having spaced upper and lower elongated support elements joined between corresponding opposite ends thereof by respective spaced elongated side support elements;

a stretchable fabric display face disposed across the space defined by said framework;

a hinge affixed to at least one of said support elements;

a hinge pin mated within said hinge to rotate therein;

means for limiting said hinge pin in extent of rotation within said hinge pin;

means for coupling to said hinge pin one marginal portion of said fabric;

a finger affixed to and projecting laterally outward away from said hinge;

means for securing said finger to said one support element;

and said one support element being shaped to define a recess spaced from but alongside said finger and in which a cleat projects from said finger and seats in said recess.

56. A display sign comprising:

a sign framework having spaced upper and lower elongated support elements joined between corresponding opposite ends thereof by respective spaced elongated side support elements;

a stretchable fabric display face disposed across the space defined by said framework;

a hinge affixed to at least one of said support elements;

a hinge pin mated within said hinge to rotate therein;

means for limiting said hinge pin in extent of rotation within said hinge pin;

means for coupling to said hinge pin one marginal portion of said fabric;

a finger affixed to and projecting laterally outward away from said hinge;

means for securing said finger to said one support element;

said one support element being shaped to define a flat surface facing said finger;

and said finger being in the form of a web one side of which lies against said flat surface.

57. A display sign comprising:

a sign framework having spaced upper and lower elongated support elements joined between corresponding opposite ends thereof by respective spaced elongated side support elements;

a stretchable fabric display face disposed across the space defined by said framework;

a hinge affixed to at least one of said support elements;

a hinge pin mated within said hinge to rotate therein;

means for limiting said hinge pin in extent of rotation within said hinge pin;

means for coupling to said hinge pin one marginal portion of said fabric;

a lever affixed at one end to and projecting laterally away from said hinge pin;

a stop carried by said one support element and disposed in the path of said lever to define a limit of rotation of said hinge pin;

and said stop projecting laterally outward away from said hinge in a direction away from said one support element.

58. A display sign comprising:

a sign framework having spaced upper and lower elongated support elements joined between corrresponding opposite ends thereof by respective spaced elongated side support elements;

a stretchable fabric display face disposed across the space defined by said framework;

a hinge affixed to at least one of said support elements;

a hinge pin mated within said hinge to rotate therein;

means for limiting said hinge pin in extent of rotation within said hinge pin;

means for coupling to said hinge pin one marginal portion of said fabric;

a lever affixed at one end to and projecting laterally away from said hinge pin;

a stop carried by said one support element and disposed in the path of said lever to define a limit of rotation of said hinge pin;

and said stop being in the form of a flange having a free end portion that is turned to project toward the support element opposite said one support element.

59. A display sign comprising:

a sign framework having spaced upper and lower elongated support elements joined between corresponding opposite ends thereof by respective spaced elongated side support elements;

a stretchable fabric display face disposed across the space defined by said framework;

a hinge affixed to at least one of said support elements;

a hinge pin mated within said hinge to rotate therein;

means for limiting said hinge pin in extent of rotation within said hinge pin;

means for coupling to said hinge pin one marginal portion of said fabric;

a lever affixed at one end to and projecting laterally away from said hinge pin;

said lever projecting laterally outward from said hinge pin in a direction laterally away from said one support element;

a flange carried by and projecting outwardly from said one support element in a direction laterally away therefrom;

and the free end of said lever being spaced beyond the free end of said flange in a direction laterally away from said one support element.

60. A display sign as defined in claim 59 in which said fabric continues from said marginal portion as a skirt portion thereof that further continues into a central portion thereof.

61. A display sign as defined in claim 60 in which said skirt portion lies adjacent to the side of said lever opposite said flange.

62. A display sign as defined in claim 61 in which the free end portion of said lever is bent to project toward another support element opposite said one support element and said central portion continues in a direction toward said other support element.

63. A display sign as defined in claim 62 which includes means for maintaining said fabric under tension, in which said hinge pin is insertable within said hinge from a location apart therefrom, and in which said flange is oriented to define a cam surface over which said hinge pin may be slid and then inserted within said hinge.

64. A display sign comprising:

a sign framework having spaced upper and lower elongated support elements joined between corresponding opposite ends thereof by respective spaced elongated side support elements;

a stretchable fabric display face disposed across the space defined by said framework;

a hinge affixed to at least one of said support elements;

a hinge pin mated within said hinge to rotate therein;

means for limiting said hinge pin in extent of rotation within said hinge pin;

means for coupling to said hinge pin one marginal portion of said fabric;

means, affixed to another of said support elements spaced opposite said one element, for fastening another marginal portion of said fabric, spaced opposite said one marginal portion, to said other support element;

a lip projecting laterally outward away from said other support element in a direction generally lateral to said display face;

said fabric continuing away from said other marginal portion as a skirt that continues into a central portion with said skirt lying against the side of said lip opposite said one support element;

and the free end of said lip being bent to project in a direction generally toward said one support member.

65. A display sign as defined in claim 64 which includes a flange projecting laterally outward from said other support element in a direction generally lateral to said display face and disposed on the side of said lip toward said one support element, together with means for removably affixing said lip to said other support element, and in which said fastening means secures said other marginal portion to said lip.

66. A display sign as defined in claim 65 in which, with said fabric stretched in tension, said lip is slidable over said flange to cam said lip into a position whereat said lip is affixed to said other support element.

67. A display sign comprising:

a sign framework having spaced upper and lower elongated support elements joined between corresponding opposite ends thereof by respective spaced elongated side support elements;

a stretchable fabric display face disposed across the space defined by said framework;

a hinge affixed to at least one of said support elements;

a hinge pin mated within said hinge to rotate therein;

means for limiting said hinge pin in extent of rotation within said hinge pin;

means for coupling to said hinge pin one marginal portion of said fabric;

said hinge including a segment shaped to partially encircle said hinge pin;

said hinge pin presenting a surface nested within said segment;

a lip projecting laterally outward away from said hinge pin in a direction generally away from one support element;

and said fabric continuing away from said marginal portion at said hinge as a skirt portion that overlies said lip.

68. A display sign comprising:

a sign framework having spaced upper and lower elongated support elements joined between corresponding opposite ends thereof by respective spaced elongated side support elements;

a stretchable fabric display face disposed across the space defined by said framework;

a removable clip shaped to clamp a marginal portion of said fabric in a position fixed with respect to one of said support elements;

means defining a latch surface affixed with respect to said one support element;

a latch member included on said clip and lockingly engageable with said latch surface;

means for hingedly securing said clip with respect to said one support element, said clip thereby being swingable to move said latch member into engagement with said latch surface;

and said latch surface being disposed on the side of said securing means toward the central portion of said fabric with said marginal portion being clamped between said latch member and said latch surface and also within said securing means.

69. A display sign comprising:

a sign framework having spaced upper and lower elongated support elements joined between corresponding opposite ends thereof by respective spaced elongated side support elements;

a stretchable fabric display face disposed across the space defined by said framework;

and means, including a plurality of lips individually projecting laterally outwardly away from respective ones of said support elements, for fastening corresponding ones of the marginal portions of said fabric to respective ones of said support elements, with said fabric continuing from each of said marginal portions as a skirt that overlies the corresponding one of said lips and further continuing around the free end portion of that lip into a common central portion.

70. A display sign as defined in claim 69 in which each of the free end portions of said lips is bent to project in a direction toward a space-opposed one of said lips.

71. A display sign as defined in claim 69 in which said fastening means includes means for adjusting tension in said fabric.

72. A display sign as defined in claim 71 in which said fastening means also includes means for enabling movement of selected sections of said marginal portions in a direction along the length of corresponding ones of said support elements.

73. A display sign comprising:

a sign framework having spaced upper and lower elongated support elements joined between corresponding opposite ends thereof by respective spaced elongated side support elements;

a stretchable fabric display face disposed across the space defined by said framework;

means, including a plurality of lips individually projecting laterally outward away from respective ones of said support elements, for fastening corresponding ones of the marginal portions of said fabric to respective ones of said support elements, with said fabric continuing from each of said marginal portions as a skirt that overlies the corresponding one of said lips and further continuing around the free end portion of that lip into a common central portion;

and a flange projecting laterally outward away from at least one of said support elements in a direction toward said display face and on the side of the corresponding one of said lips opposite said skirt with said flange projecting a distance less than the distance of projection of said one lip.

74. A display sign as defined in claim 73 in which the corresponding one of said marginal portions is fastened directly to said one lip;

in which, with said fabric stretched in tension, said lip is slidable over said flange to cam said lip into a position adjacent to said one support element;

and which includes means for securing said one lip to said one support element.

75. A display sign comprising:

a sign framework having spaced upper and lower elongated support elements joined between corresponding opposite ends thereof by respective spaced elongated side support elements;

a stretchable fabric display face disposed across the space defined by said framework;

means, including a plurality of lips individually projecting laterally outward away from respective ones of said support elements, for fastening corresponding ones of the marginal portions of said fabric to respective ones of said support elements, with said fabric continuing from each of said marginal portions as a skirt that overlies the corresponding one of said lips and further continuing around the free end portion of that lip into a common central portion;

and a flange projecting laterally outward away from each of said support elements in a direction toward said display face and on the side of the corresponding one of said lips opposite said skirt with the flange projecting a distance less than the distance of projection of that one lip.

76. A display sign as defined in claim 75 in which at least certain of said marginal portions individually are fastened directly to respective ones of said lips;

in which, with said fabric stretched under tension, said frame is slidable over said flanges to cam said frame into a position adjacent to said framework;

and which includes means for securing said frame to said framework.

77. A display sign comprising:

a sign framework having spaced upper and lower elongated support elements joined between corresponding opposite ends thereof by respective spaced elongated side support elements;

a stretchable fabric display face disposed across the space defined by said framework;

means, including a plurality of lips individually projecting laterally outward away from respective ones of said support elements, for fastening corresponding ones of the marginal portions of said fabric to respective oes of said support elements, with said fabric continuing from each of said marginal portions as a skirt that overlies the corresponding one of said lips and further continuing around the free end portion of that lip into a common central portion;

said lips being joined in succession one to the next to define a frame matable with said framework;

means for hingedly securing one margin of said frame along one margin of said framework;

and means for holding said frame in closing relationship with said framework.

78. A display sign as defined in claim 77 in which at least one of said support elements includes a generally U-shaped member having legs integrally joined by a bight;

a pair of lugs projecting inwardly from one of said legs toward the other of said legs;

a shelf projecting inwardly from the other of said legs toward said one leg;

a plate inserted along one margin thereof between said lugs and with the opposite margin thereof positioned against said shelf;

and means for removably securing said opposite margin against said shelf.

79. A display sign comprising:

a sign framework having spaced upper and lower elongated support elements joined between corresponding opposite ends thereof by respective spaced elongated side support elements;

a stretchable fabric display face disposed across the space defined by said framework;

means, including a plurality of lips individually projecting laterally outward away from respective ones of said support elements, for fastening corresponding ones of the marginal portions of said fabric to respective ones of said support elements, with said fabric continuing from each of said marginal portions as a skirt that overlies the corresponding one of said lips and further continuing around the free end portion of that lip into a common central portion;

and a bezel joined at each of said support elements and disposed to at least substantially overlie and conceal said lips and said fastening means.

80. A display sign comprising:

a sign framework having spaced upper and lower elongated support elements joined between corresponding opposite ends thereof by respective spaced elongated side support elements;

a stretchable fabric display face disposed across the space defined by said framework;

means affixed to opposing ones of said support elements for fastening respective opposite marginal portions of said fabric between said opposing support elements;

means for adjustably stretching said fabric in tension between said opposing support elements;

means defining at least one visually-observable line on and across the exterior surface of said fabric and parallel to said opposing support elements;

means fixed in position with respect to one of said opposing support elements for defining a reference point;

and said line being in a location exposed to view from the exterior of said display face when said stretching means is adjusted to remove substantially said tension in said fabric but said line being movable toward said reference point upon adjustment of said stretching means to induce and increase said tension in said fabric.

81. A display sign comprising:

a sign framework having spaced upper and lower elongated support elements joined between corresponding opposite ends thereof by respective spaced elongated side support elements;

a continuous frame having upper and lower members joined between corresponding opposite ends by respective side members;

means for removably securing said frame to said framework with individual different ones of said members disposed adjacent to respective different ones of said elements;

a stretchable fabric display face disposed across the space defined by said frame;

means for fastening corresponding ones of the marginal portions of said fabric to respective ones of said members;

means included in said fastening means for selectively adjusting tension previously induced in said fabric between oppositely-spaced segments of the space-opposed pairs of said marginal portions;

and means also included in said fastening means for releasing tension selectively between individual diferent oppositely-spaced ones of said segments, enabling selective movement of individual ones of said segments in a direction along the length of corresponding ones of said members.

82. A display sign as defined in claim 81 which further includes:

means for hingedly securing one margin of said frame along one margin of said framework;

and means for holding said frame in closing relationship with said framework.

* * * * *

UNITED STATES PATENT OFFICE
CERTIFICATE OF CORRECTION

Patent No. 4,265,039 Dated May 5, 1981

Inventor(s) Jackson R. Brooks

It is certified that error appears in the above-identified patent and that said Letters Patent are hereby corrected as shown below:

IN THE CLAIMS

Claim 1, Column 23, Line 24: delete "pin".

Claim 53, Column 26, Line 51: delete "pin".

Claim 55, Column 27, Line 9: delete "pin".

Claim 56, Column 27, Line 31: delete "pin".

Claim 57, Column 27, Line 53: delete "pin".

Claim 58, Column 28, Line 7: delete "pin".

Claim 59, Column 28, Line 31: delete "pin".

Claim 64, Column 29, Line 7: delete "pin".

Claim 67, Column 29, Line 49: delete "pin".

Signed and Sealed this

*Thirteenth* Day of *April 1982*

[SEAL]

*Attest:*

GERALD J. MOSSINGHOFF

*Attesting Officer* *Commissioner of Patents and Trademarks*

UNITED STATES PATENT OFFICE

CERTIFICATE OF CORRECTION

Patent No. 4,265,039 Dated May 5, 1981

Inventor(s) Jackson R. Brooks

It is certified that error appears in the above-identified patent and that said Letters Patent are hereby corrected as shown below:

Column 1, Line 44: cancel "cam" and substitute -- came --.

Column 2, Line 15: cancel "signal" and substitute -- single --.

Column 3, Line 17: cancel "insepection" and substitute -- inspection --.

Column 3, Line 23: cancel "anlge" and substitute -- angle --.

Column 4, Line 30: cancel "mens" and substitute -- means --.

Column 4, Line 68: cancel "aroudnd" and substitute -- around --.

Column 6, Line 33: cancel "axuiliary" and substitute -- auxiliary --.

Column 7, Line 10: cancel "an" and substitute -- and --.

UNITED STATES PATENT OFFICE
CERTIFICATE OF CORRECTION

Patent No. 4,265,039 Dated May 5, 1981

Inventor(s) Jackson R. Brooks

It is certified that error appears in the above-identified patent and that said Letters Patent are hereby corrected as shown below:

Column 10, Line 60: after "inner" insert -- wall --.

Column 17, Line 47: after "When" insert -- used in a support element that is associated with fastener 230, --.

Column 18, Line 49: cancel "deliverly" and substitute -- "delivery" --.

Column 19, Line 68: cancel "lipw" and substitute -- lips --.

Column 20, Line 29: cancel "agains" and substitute -- again --.

Column 20, Line 54: cancel "existig" and substitute -- existing --.

Column 22, Line 19: cancel "hing" and substitute -- hinge --.

UNITED STATES PATENT OFFICE
CERTIFICATE OF CORRECTION

Patent No. 4,265,039 Dated May 5, 1981

Inventor(s) Jackson R. Brooks

It is certified that error appears in the above-identified patent and that said Letters Patent are hereby corrected as shown below:

Column 31, Line 25: after "portion" and before the semicolon, insert -- , said lips being joined in succession one to the next to define a frame mateable to said frame work --.

Signed and Sealed this

*Fifth* Day of *November 1985*

[SEAL]

*Attest:*

*Attesting Officer*

DONALD J. QUIGG

*Commissioner of Patents and Trademarks*